US011994151B1

(12) United States Patent
Lai et al.

(10) Patent No.: US 11,994,151 B1
(45) Date of Patent: May 28, 2024

(54) GUIDING GRID

(71) Applicant: Delta Electronics, Inc., Taoyuan (TW)

(72) Inventors: Wei-Ming Lai, Taoyuan (TW); Yi-Ta Lu, Taoyuan (TW); Wei-Chun Hsu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/113,978

(22) Filed: Feb. 24, 2023

(30) Foreign Application Priority Data

Dec. 21, 2022 (CN) ..... 202223433869.4

(51) Int. Cl.
*F04D 29/70* (2006.01)
*F04D 19/00* (2006.01)
*F04D 29/66* (2006.01)

(52) U.S. Cl.
CPC ..... *F04D 29/703* (2013.01); *F04D 19/002* (2013.01); *F04D 29/667* (2013.01)

(58) Field of Classification Search
CPC ..... F04D 29/703
See application file for complete search history.

(56) References Cited

U.S. PATENT DOCUMENTS

| | | | | |
|---|---|---|---|---|
| D775,721 | S | 1/2017 | Müller et al. | |
| D776,250 | S | 1/2017 | Müller et al. | |
| D894,366 | S | 8/2020 | Gebert et al. | |
| 10,760,593 | B2 | 9/2020 | Strehle et al. | |
| 10,781,829 | B2 | 9/2020 | Müller et al. | |
| 2005/0238481 | A1* | 10/2005 | Yamamoto | F04D 29/703 415/121.2 |
| 2009/0110542 | A1* | 4/2009 | Kim | F04D 29/703 415/121.2 |
| 2010/0003149 | A1* | 1/2010 | Nelson | F04D 29/703 415/121.2 |
| 2021/0164495 | A1 | 6/2021 | Loercher et al. | |

FOREIGN PATENT DOCUMENTS

| | | | |
|---|---|---|---|
| CN | 109990328 | A | 7/2019 |
| DE | 102014116047 | A1 | 5/2016 |
| DE | 102018205300 | A1 | 10/2019 |
| EP | 3111094 | B1 | 1/2018 |
| JP | 2019078174 | A | 5/2019 |
| WO | 2017041967 | A1 | 3/2017 |

* cited by examiner

*Primary Examiner* — Brian O Peters
(74) *Attorney, Agent, or Firm* — KIRTON McCONKIE; Evan R. Witt

(57) ABSTRACT

A guiding grid is disclosed and includes plural circumferential elements and plural radial elements. The circumferential elements are disposed concentrically relative to a central axis, spaced apart from each other in a radial direction, and form different heights relative to a bottom surface. One of the circumferential elements forms a top height relative to the bottom surface, so that the circumferential elements are divided into an outer-ring region and a central region in the radial direction. The circumferential elements located in the central region are increased in height relative to the bottom surface along the radial direction. The circumferential element located in the outer ring region are reduced in height relative to the bottom surface along the radial direction. The radial elements are connected between each of two adjacent circumferential elements. At least one of the radial elements is misaligned and discontinuous in the radial direction.

13 Claims, 25 Drawing Sheets

GUIDING GRID

CROSS-REFERENCE TO RELATED APPLICATION

This application claims priority to China Patent Application No. 202223433869.4, filed on Dec. 21, 2022. The entire contents of the above-mentioned patent application are incorporated herein by reference for all purposes.

FIELD OF THE INVENTION

The present disclosure relates to a guiding grid, and more particularly to a guiding grid in connection with an inlet of a fan to protect the internal components of the fan and provide the functions of guiding flow and reducing noise at the same time.

BACKGROUND OF THE INVENTION

A fan is capable of driving an airflow to flow. In use, the airflow flows through the interior of the fan. In order to prevent foreign objects from invading the interior of the fan, a grid structure is often disposed adjacent to inlet of the fan, such as the centrifugal fan, to provide the protection. A conventional grid structure adopts a simple circular symmetrical design, and includes a plurality of circumferential ribs and radial ribs assembled together. When the required strength of the structural support is limited, although the higher density of ribs included in the grid has advantage of providing high-strength structural support, the resulting diversion effect is worse and the flow loss is greater. In other words, the arrangement design of the ribs disposed on the grid not only provides the function of protecting the internal components of the fan, but also affects the operation characteristics of the fan. The rib arrangement of the conventional grid design has poor effect of guiding flow guiding, and an air swirl is formed easily. Especially, when a higher volume flow passes through the grid, it is more likely to generate louder noises.

Therefore, there is a need of providing a guiding grid in connection with an inlet of a fan to prevent protect the internal components of the fan and provide the functions of guiding flow and reducing noise at the same time.

SUMMARY OF THE INVENTION

An object of the present disclosure is to provide a guiding grid in connection with an inlet of a fan, so as to prevent the foreign matter from entering, protect the internal components of the fan, provide a uniform and stable flow field, and reduce the noise of the flow field. The guiding grid includes a plurality of radial elements extended from a bottom surface of an outer peripheral edge to a central axis and connected to a plurality of circumferential elements so as to provide sufficient compressive strength and increase the reliability of the product. In addition, the plurality of radial elements are increased in number from the inside to the outside or are not parallel in the radial arrangement, so that the guiding grid is asymmetrically designed. It has advantages of providing the function of guiding, dispersing the blade-passage frequency (BPF), and reducing the generation of high-frequency noise. On the other hand, the guiding grid is integrally formed by stamping a metal material, or produced by plastic injection molding. Furthermore, the guiding grid is fixed to the fan by using the locking holes of the connection elements, and the assembly procedure is simple.

In addition, when the guiding grid is manufactured by metal stamping or injection molding, it is easy to adjust the combination of the circumferential elements and the radial elements so as to increase the variations of the guiding flow adjacent to the inlet of the fan, ensure the compressive strength of the guiding grid, and achieve the purpose of reducing noise.

In accordance with an aspect of the present disclosure, a guiding grid is provided and in contact with an inlet of a fan. The guiding grid includes a plurality of circumferential elements and a plurality of radial elements. The plurality of circumferential elements are disposed concentrically relative to a central axis, spaced apart from each other in a radial direction, and form different heights relative to a bottom surface in a side direction perpendicular to the central axis. One of the circumferential elements forms a top height relative to the bottom surface so that the circumferential elements are divided into an outer-ring region and a central region in the radial direction. The plurality of circumferential elements located in the central region are increased in height relative to the bottom surface from the central axis along the radial direction, and the plurality of circumferential element located in the outer ring region are reduced in height relative to the bottom surface along the radial direction. The plurality of radial elements are connected between each of two adjacent circumferential elements. At least one of the radial elements is misaligned and discontinuous in the radial direction.

In accordance with another aspect of the present disclosure, a guiding grid is provided and in contact with an inlet of a fan. The guiding grid includes a plurality of circumferential elements and a plurality of radial elements. The plurality of circumferential elements are disposed concentrically relative to a central axis, spaced apart from each other in a radial direction, and form different heights relative to a bottom surface in a side direction perpendicular to the central axis. The plurality of circumferential elements are reduced in height relative to the bottom surface along the radial direction, and a closest one of the circumferential elements adjacent to the central axis forms a top height relative to the bottom surface. The plurality of radial elements are connected between each of two adjacent circumferential elements. At least one of the radial elements is misaligned and discontinuous in the radial direction.

In accordance with a further aspect of the present disclosure, a guiding grid is provided and in contact with an inlet of a fan. The guiding grid includes a plurality of circumferential elements and a plurality of radial elements. The plurality of circumferential elements are disposed concentrically relative to a central axis, spaced apart from each other in a radial direction, and form different heights relative to a bottom surface in a side direction perpendicular to the central axis. One of the circumferential elements forms a top height relative to the bottom surface so that the circumferential elements are divided into an outer-ring region and a central region in the radial direction. The plurality of circumferential elements located in the central region are increased in height relative to the bottom surface from the central axis along the radial direction, and the plurality of circumferential element located in the outer ring region are reduced in height relative to the bottom surface along the radial direction. The plurality of radial elements are connected between each of two adjacent circumferential elements, and disconnected with the central axis in the radial direction.

In accordance with an aspect of the present disclosure, a guiding grid is provided and in contact with an inlet of a fan.

The guiding grid includes a plurality of circumferential elements and a plurality of radial elements. The plurality of circumferential elements are disposed concentrically relative to a central axis, spaced apart from each other in a radial direction, and forming different heights relative to a bottom surface in a side direction perpendicular to the central axis. The plurality of circumferential elements are reduced in height relative to the bottom surface along the radial direction, and a closest one of the circumferential elements adjacent to the central axis forms a top height relative to the bottom surface. The plurality of radial elements are connected between each of two adjacent circumferential elements and disconnected with the central axis in the radial direction.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

Figure 1:
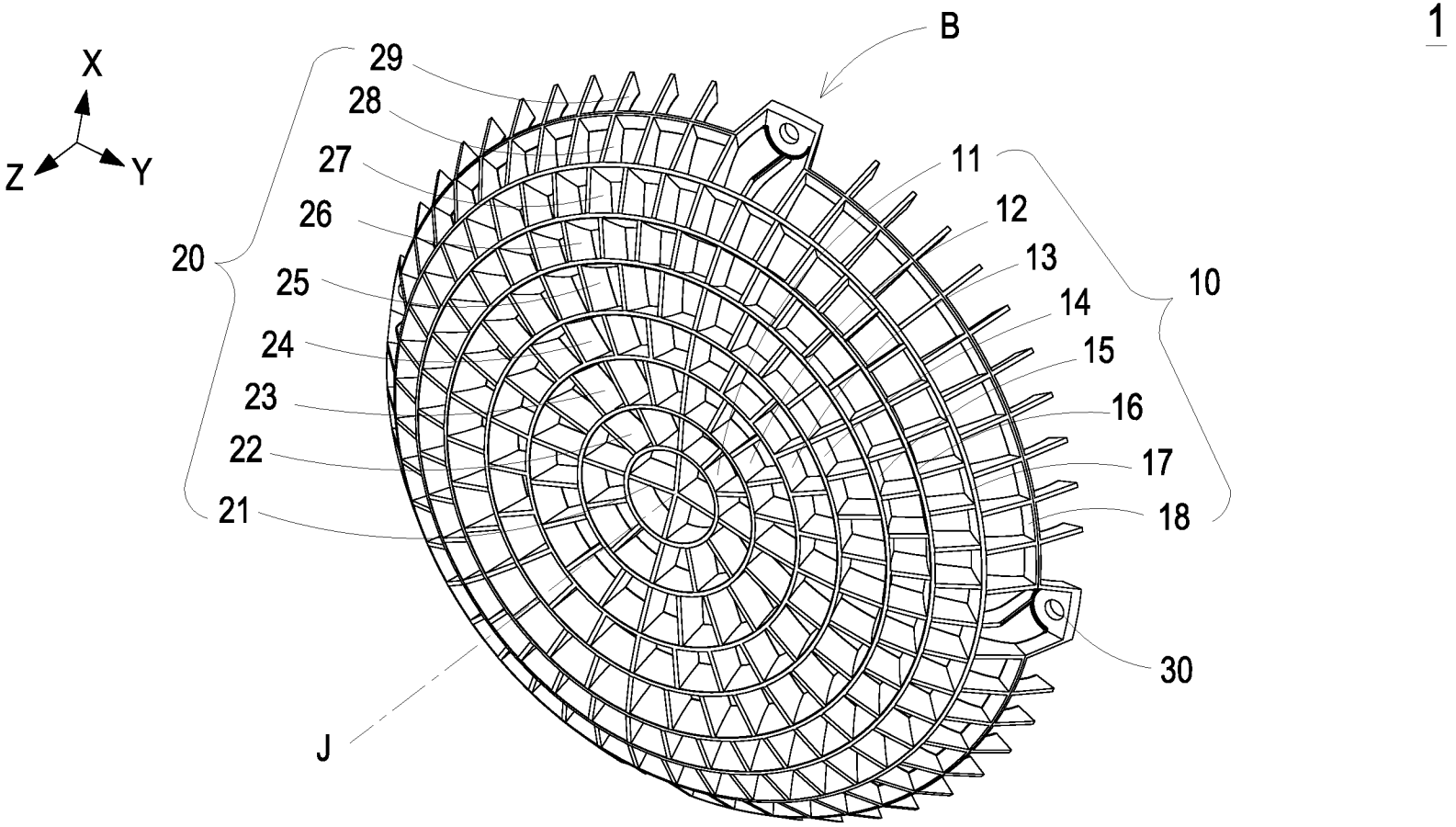
FIG. 1 is a perspective view illustrating a guiding grid according to a first embodiment of the present disclosure.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed. The present disclosure may repeat reference numerals and/or letters in the various examples. This repetition is for the purpose of simplicity and clarity and does not in itself dictate a relationship between the various embodiments and/or configurations discussed. Further, spatially relative terms, such as "radial", "axial", "top", "bottom" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. Furthermore, in the present disclosure, the numbers of the circumferential elements, the radial elements and the connection elements are only examples of the implementation and are not limited thereto.

FIG. 1 is a perspective view illustrating a guiding grid according to a first embodiment of the present disclosure. In the embodiment, the guiding grid 1 is configured in contact with an inlet of a fan, for example an inlet of a centrifugal fan. The guiding grid 1 includes a plurality of circumferential elements 10 and a plurality of radial elements 20. Preferably but not exclusively, the plurality of circumferential elements 10 includes eight ring-shape circumferential elements 11, 12, 13, 14, 15, 16, 17, 18, which are disposed concentrically relative to a central axis J. The plurality of radial elements 20 are connected between each of two adjacent circumferential elements 11, 12, 13, 14, 15, 16, 17, 18. Preferably but not exclusively, the circumferential element 11 and the circumferential element 12 are connected through the radial element 22, the circumferential element 12 and the circumferential element 13 are connected through the radial element 23, the circumferential element 13 and the circumferential element 14 are connected through the radial element 24, the circumferential element 14 and the circumferential element 15 are connected through the radial element 25, the circumferential element 15 and the circumferential element 16 are connected through the radial element 26, the circumferential element 16 and the circumferential element 17 are connected through the radial element 27, and the circumferential element 17 and the circumferential element 18 are connected through the radial element 28. In addition, a closest one of the circumferential elements 10 adjacent to the central axis J is the circumferential element 11, which is connected to the central axis J through the radial element 21. Preferably but not exclusively, in the embodiment, the plurality of circumferential elements 10 and the plurality of radial elements 20 have the same thickness and are integrally formed in to one piece. Each of two adjacent circumferential elements 10 have the radial elements 20 correspondingly connected therebetween in a straight line or a curved line. The guiding grid 1 further includes a plurality of connection elements 30. Preferably but not exclusively, the plurality of connection elements 30 are in the shape of the locking hole, and the guiding grid 1 is fastened on the fan frame of the centrifugal fan through the connection elements 30 and in contact with the inlet of the fan. In the embodiment, the connection elements 30 are connected to the circumferential elements 17, 18 through the radial elements 28, 29. Notably, in the embodiment, a number of the radial elements 20, such as the radial elements 28, 29, correspondingly connected to a father one of the circumferential elements 10, such as the circumferential element 18, away from the central axis J is greater than a number of the radial elements 20, such as the radial element 21, 22, correspondingly connected to a closer one of the circumferential elements 10, such as the circumferential element 11 adjacent to the central axis J. Namely, the plurality of radial elements 21, 22, 23, 24, 25, 26, 27, 28, 29 are increased in number from the central axis J along the radial direction so as to provide more stable structural support and a uniform and stable flow field. Certainly, the numbers of the circumferential elements 10 and the radial elements 20 are adjustable according to the practical requirements. The present disclosure is not limited thereto.

Figure 2:
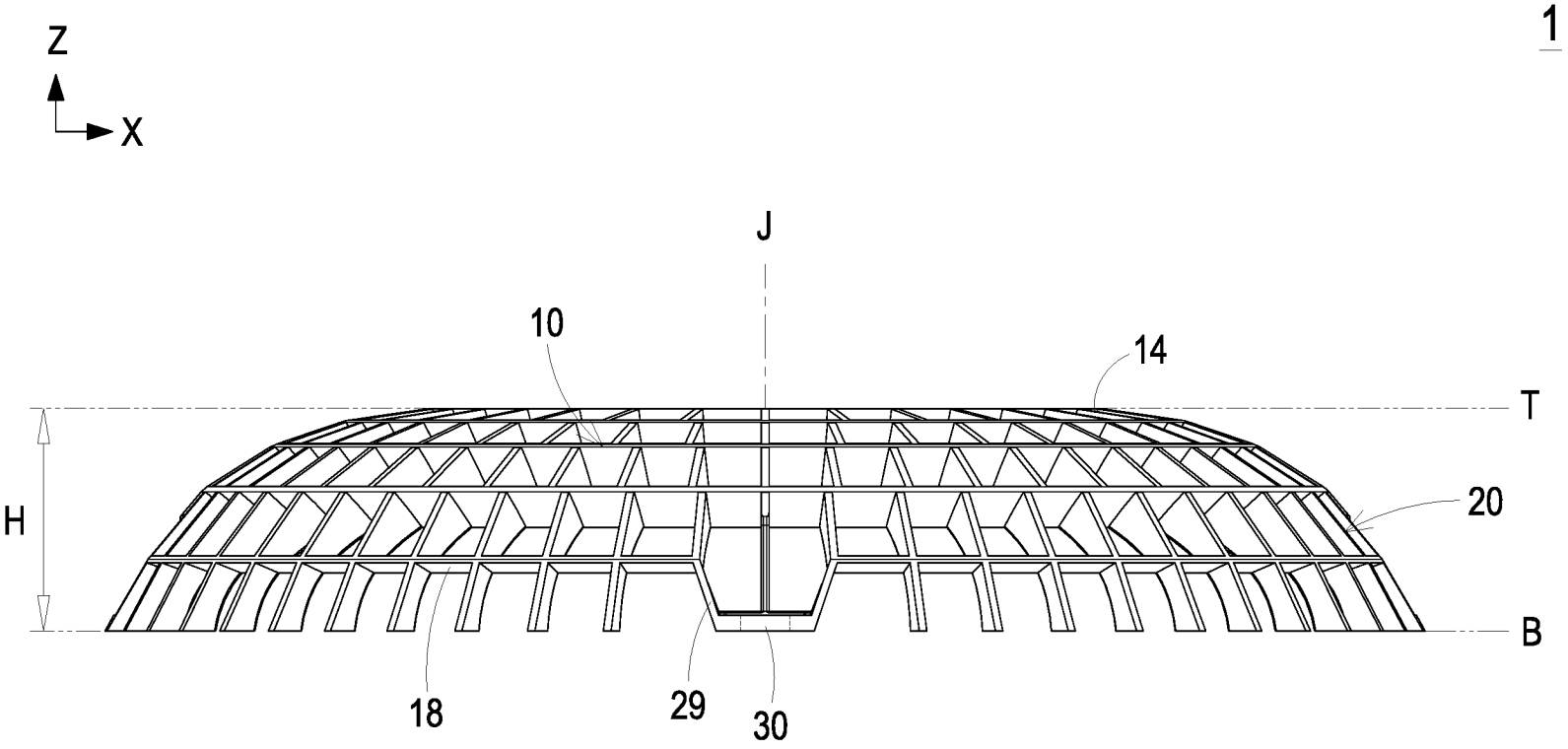
FIG. 2 is a lateral view illustrating the guiding grid according to the first embodiment of the present disclosure.

FIG. 2 is a lateral view illustrating the guiding grid according to the first embodiment of the present disclosure. In the embodiment, the connection elements 30 are configured to fasten the guiding grid 1 to the fan. The positions where the connection elements 30 are located can be defined as the bottom surface B of the guiding grid 1. On the other hand, the bottom surface B can also be regarded as a plane formed by connecting ends of the plurality of radial elements 20 in a line. In the embodiment, a farthest one of the circumferential elements 10 away from the central axis J is the circumferential element 18, which is connected to the bottom surface B through the corresponding radial element 29. In the embodiment, the plurality of circumferential elements 10 are spaced apart from each other along the radial direction, and further form different heights relative to the bottom surface B in a side direction perpendicular to the central axis J. In the embodiment, the circumferential element 14 disposed on the top T of the guiding grid 1 forms a top height H.

Figure 3:
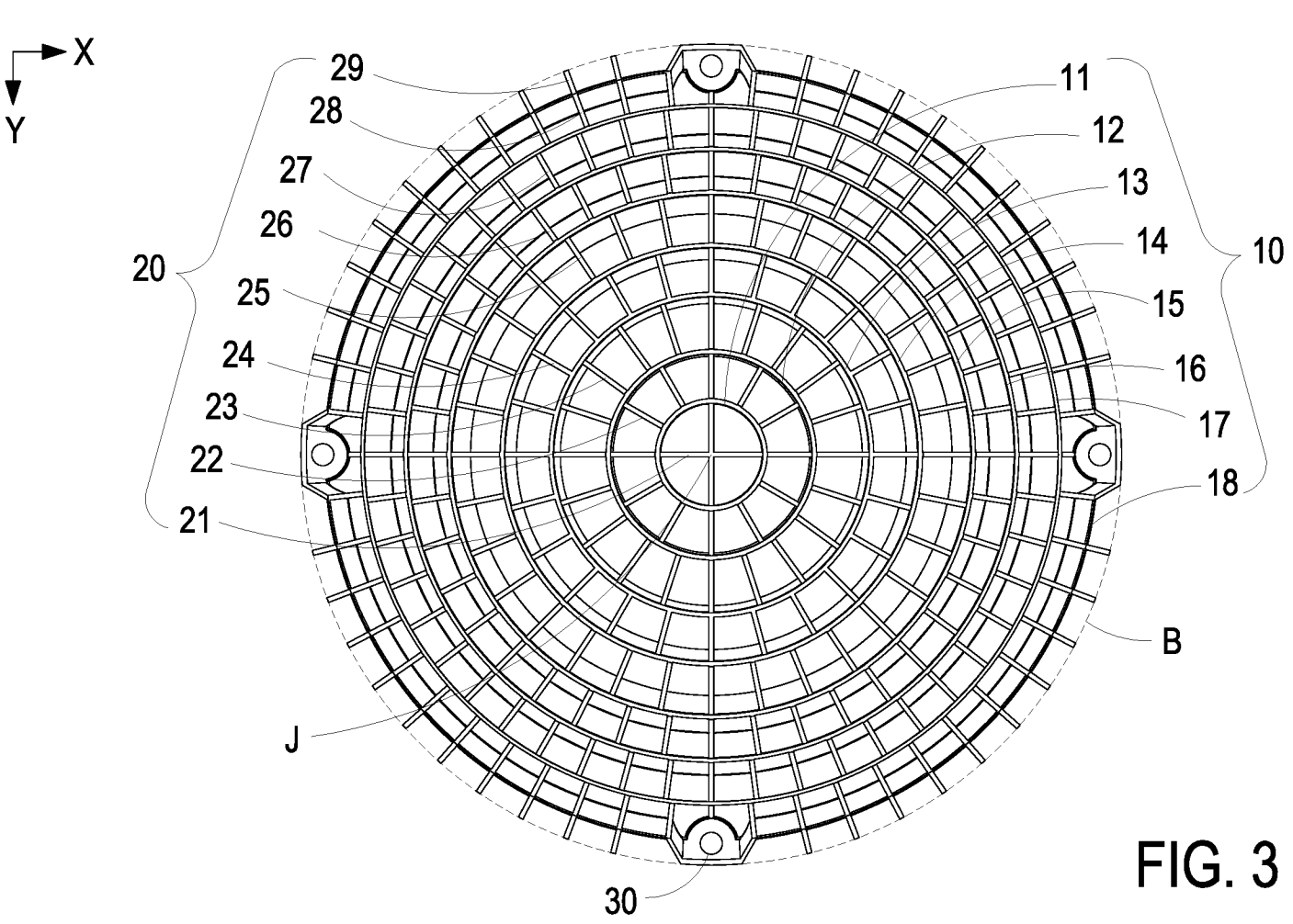
FIG. 3 is a top view illustrating the guiding grid according to the first embodiment of the present disclosure.

FIG. 3 is a top view illustrating the guiding grid according to the first embodiment of the present disclosure. In the embodiment, the guiding grid 1 includes four connection elements 30, which are spatially corresponding to the central axis J, disposed on the bottom surface B and equally spaced apart around the central axis J. Preferably but not exclusively, the four connection elements 30 are spatially corresponding to the central axis J, and connected to the central axis J through the plurality of radial elements 21, 22, 23, 24, 25, 26, 27, 28, 29 along the radial direction. The plurality of radial elements 21, 22, 23, 24, 25, 26, 27, 28, 29 are sequentially connected between the central axis J and the connection element 30 and arranged in a straight line. When the guiding grid 1 is fastened on the inlet of the fan, sufficient compressive strength is provided to maintain the stability of the entire structure, and the flow field is evenly divided into four quadrant flow fields to increase the reliability of the product. On the other hand, the plurality of radial elements 21, 22, 23, 24, 25, 26, 27, 28, 29 connected to the circumferential elements 10 are increased in number from the inside to the outside along the radial direction. Therefore, at least one of the radial elements 20 is misaligned and discontinuous in the radial. Preferably, at least 50% of the radial elements 20 are misaligned and discontinuous in the radial direction, to form an asymmetric structure. It has advantages of providing the function of guiding, dispersing the blade-passage frequency (BPF), and reducing the generation of high-frequency noise. Certainly, the increasing number of the radial elements 20 along the radial direction and the misaligned arrangement are adjustable according to the practical requirements. The present disclosure is not limited thereto.

Figure 4:
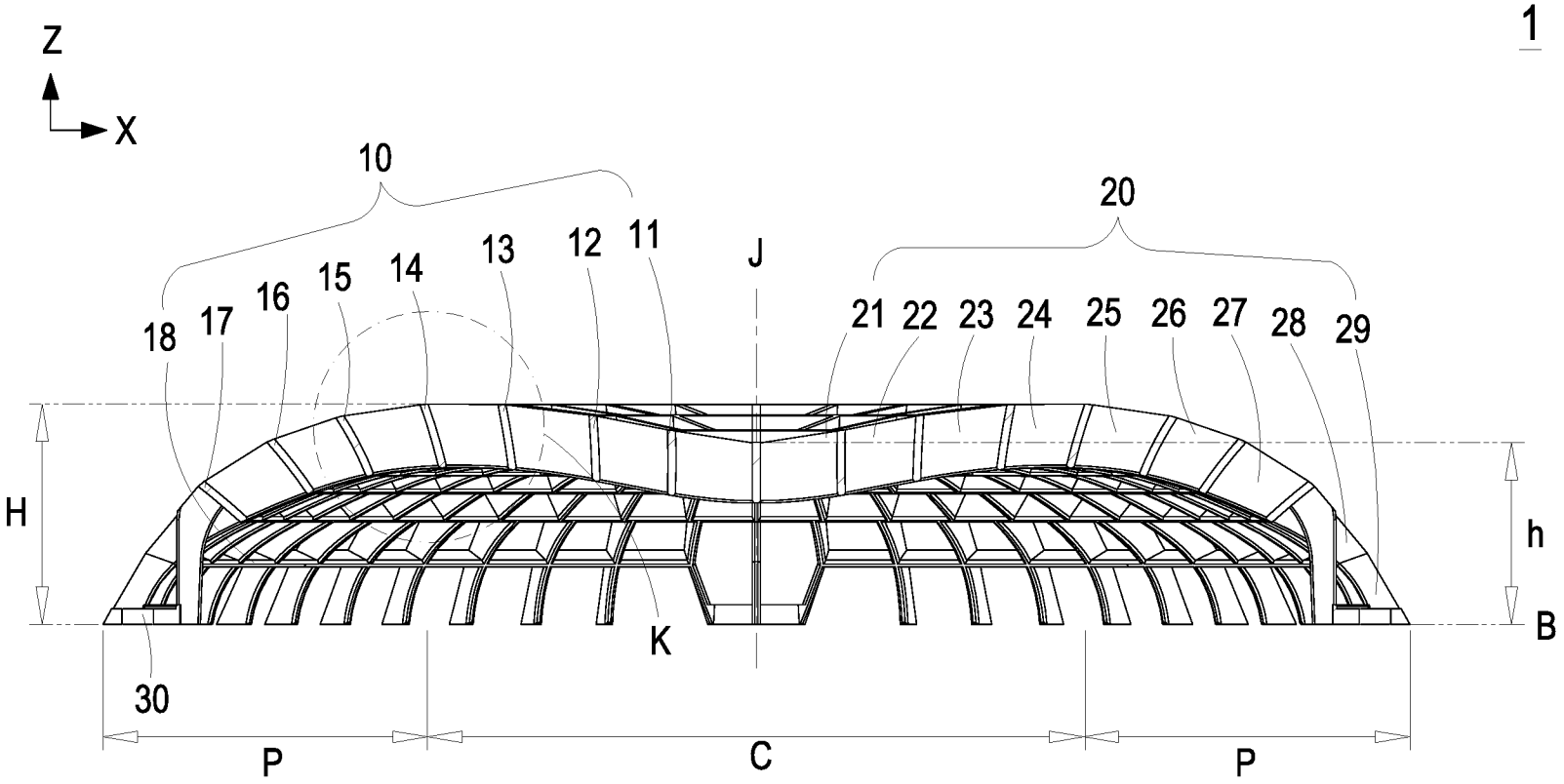
FIG. 4 is a cross-section view illustrating the guiding grid according to the first embodiment of the present disclosure.

FIG. 4 is a cross-section view illustrating the guiding grid according to the first embodiment of the present disclosure. In the embodiment, the plurality of circumferential elements 11, 12, 13, 14, 15, 16, 17, 18 are spaced apart from each other in the radial direction, and form different heights relative to the bottom surface B in the side direction perpendicular to the central axis J. One of the circumferential elements 10, the circumferential element 14, forms a top height H, so that the circumferential elements 10 are divided into an outer-ring region P and a central region C by the circumferential element 14. The plurality of circumferential elements 11, 12, 13 located in the central region C are increased in height relative to the bottom surface B from the central axis J along the radial direction, and form a central height h adjacent to the central axis J. The central height h is less than the top height H. The plurality of circumferential element 15, 16, 17, 18 located in the outer ring region P are reduced in height relative to the bottom surface B along the radial direction. Moreover, in the embodiment, the plurality of radial elements 21, 22, 23, 24, 25, 26, 27, 28, 29 sequentially connected to the plurality of circumferential elements, 11, 12, 13, 14, 15, 16, 17, 18 from inside to outside, and form a continuous curved or a plurality of connected lines. The present disclosure is not limited thereto.

Figure 5:
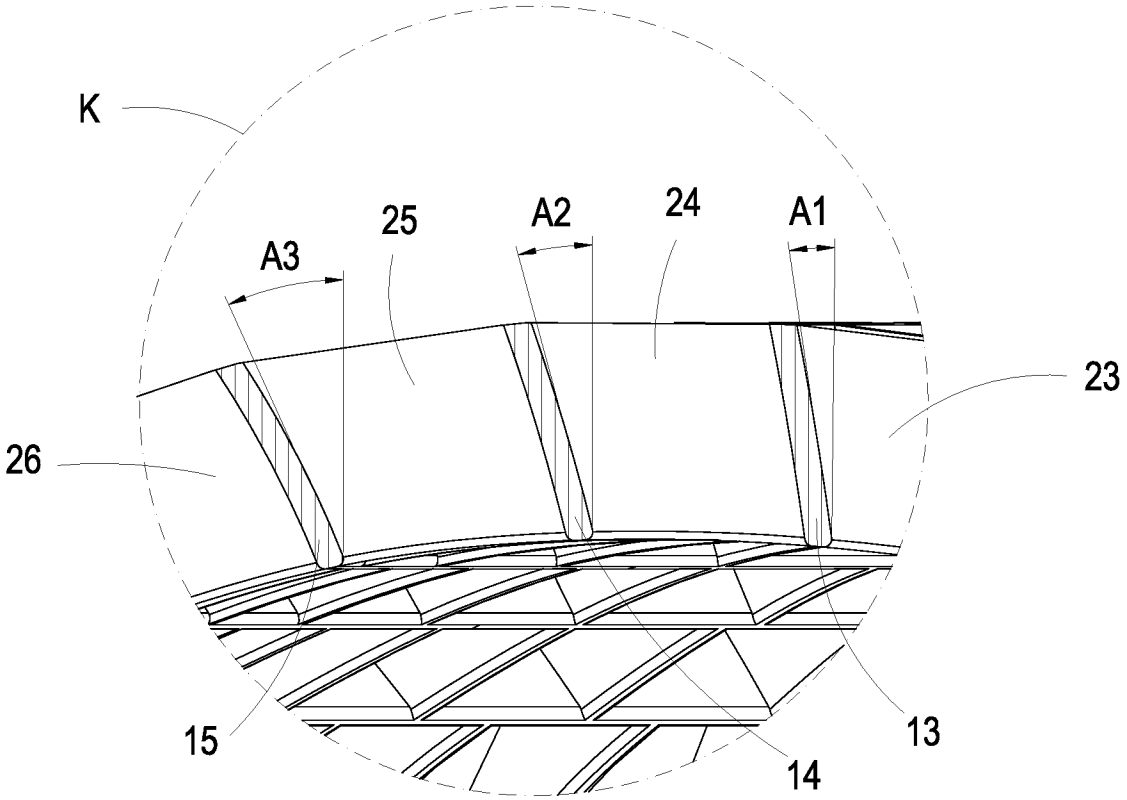
FIG. 5 is an enlarged view showing the region K in FIG. 4.

FIG. 5 is an enlarged view showing the region K in FIG. 4. In the embodiment, each of the plurality of circumferential elements 10 has an inclination angle relative to the central axis J. For example, the circumferential elements 13, 14, 15 have inclination angles A1, A2, A3 relative to the central axis J, respectively, wherein A1<A2<A3. Please refer to FIGS. 4 and 5. The circumferential element 11 close to the central axis J forms an inclination angle, which is approximately 0 degrees, and the circumferential element 18 far from the central axis J form an inclination angle horizontal but less than 90 degrees. It can be seen that in the embodiment, the inclination angles of the plurality of circumferential elements 10 are increased along the radial direction, and the inclination angles are greater than or equal to 0° and less than 90°. Certainly, the present disclosure is not limited thereto.

Figure 6:
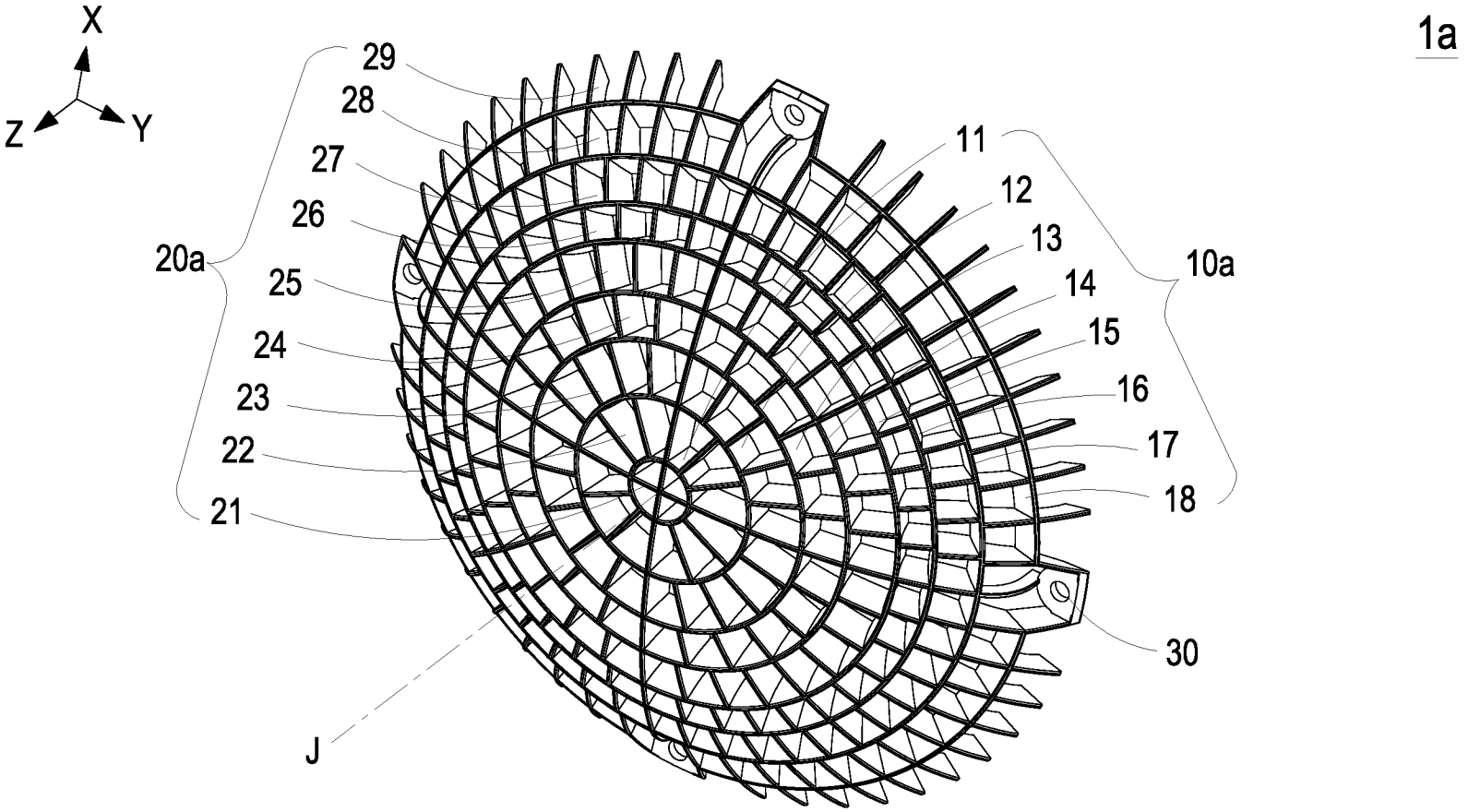
FIG. 6 is a perspective view illustrating a guiding grid according to a second embodiment of the present disclosure.

FIG. 6 is a perspective view illustrating a guiding grid according to a second embodiment of the present disclosure. In the embodiment, the structures, elements and functions of the guiding grid 1*a* are similar to those of guiding grid 1 of FIGS. 1 to 5, and are not redundantly described herein. In the embodiment, the guiding grid 1*a* includes a plurality of circumferential elements 10*a* and a plurality of radial elements 20*a*. Preferably but not exclusively, the plurality of circumferential elements 10*a* includes eight ring-shape circumferential elements 11, 12, 13, 14, 15, 16, 17, 18, which are disposed concentrically from inside to outside relative to the central axis J. The plurality of radial elements 20*a* are connected between each of two adjacent circumferential elements 11, 12, 13, 14, 15, 16, 17, 18. In the embodiment, a closest one of the circumferential elements 10*a* adjacent to the central axis J is the circumferential element 11, which is connected to the central axis J through the radial element 21. Preferably but not exclusively, in the embodiment, the plurality of circumferential elements 10*a* and the plurality of radial elements 20*a* have the same thickness and are integrally formed in to one piece. Each of two adjacent circumferential elements 10*a* have the radial elements 20*a* correspondingly connected therebetween in a straight line or a curved line. However, it is not an essential feature to limit the present disclosure, and not redundantly described herein. In the embodiment, the guiding grid 1*a* further includes a plurality of connection elements 30. Preferably but not exclusively, the plurality of connection elements 30 are in the shape of the locking hole, and the guiding grid 1*a* is fastened on the fan frame of the centrifugal fan through the connection elements 30 and in contact with the inlet of the fan. In the embodiment, the connection elements 30 are connected to the circumferential elements 17, 18 through the radial elements 28, 29. Notably, in the embodiment, a number of the radial elements 20*a*, such as the radial elements 28, 29, correspondingly connected to a father one of the circumferential elements 10, such as the circumferential element 18, away from the central axis J is greater than a number of the radial elements 20*a*, such as the radial element 21, 22, correspondingly connected to a closer one of the circumferential elements 10*a*, such as the circumferential element 11 adjacent to the central axis J. Namely, the plurality of radial elements 21, 22, 23, 24, 25, 26, 27, 28, 29 are increased in number from the central axis J along the radial direction, so as to provide more stable structural support and a uniform and stable flow field. Certainly, the numbers of the circumferential elements 10*a* and the radial elements 20*a* are adjustable according to the practical requirements. The present disclosure is not limited thereto.

Figure 7:
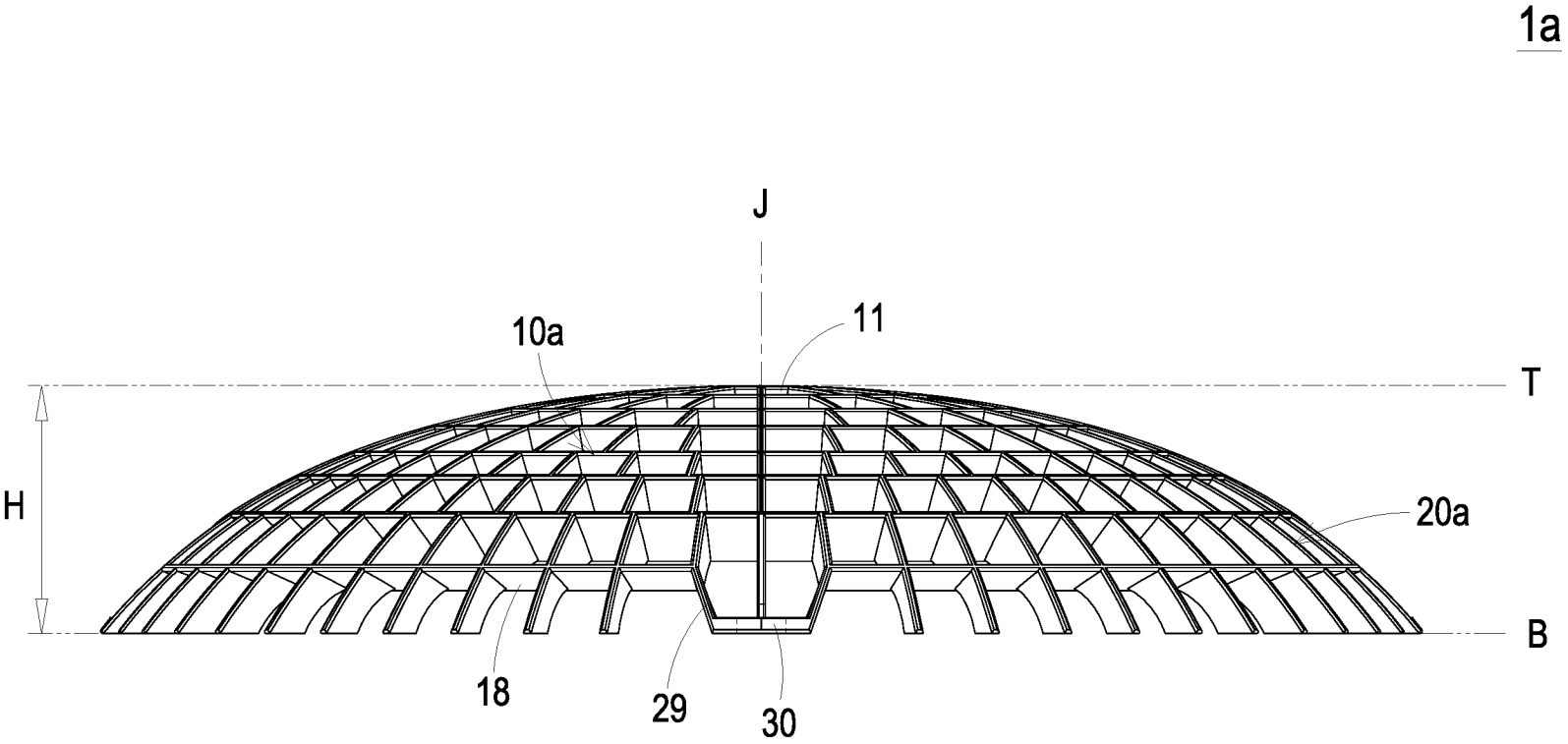
FIG. 7 is a lateral view illustrating the guiding grid according to the second embodiment of the present disclosure.

FIG. 7 is a lateral view illustrating the guiding grid according to the second embodiment of the present disclosure. In the embodiment, the connection elements 30 are configured to fasten the guiding grid 1*a* to the fan. The positions where the connection elements 30 are located can be defined as the bottom surface B of the guiding grid 1*a*. In the embodiment, a farthest one of the circumferential elements 10*a* away from the central axis J is the circumferential element 18, which is connected to the bottom surface B through the corresponding radial element 29. In the embodiment, the plurality of circumferential elements 10*a* are spaced apart from each other along the radial direction, and further form different heights relative to the bottom surface B in a side direction perpendicular to the central axis J. In the embodiment, the circumferential element 11 disposed on the top T of the guiding grid 1*a* forms a top height H.

Figure 8:
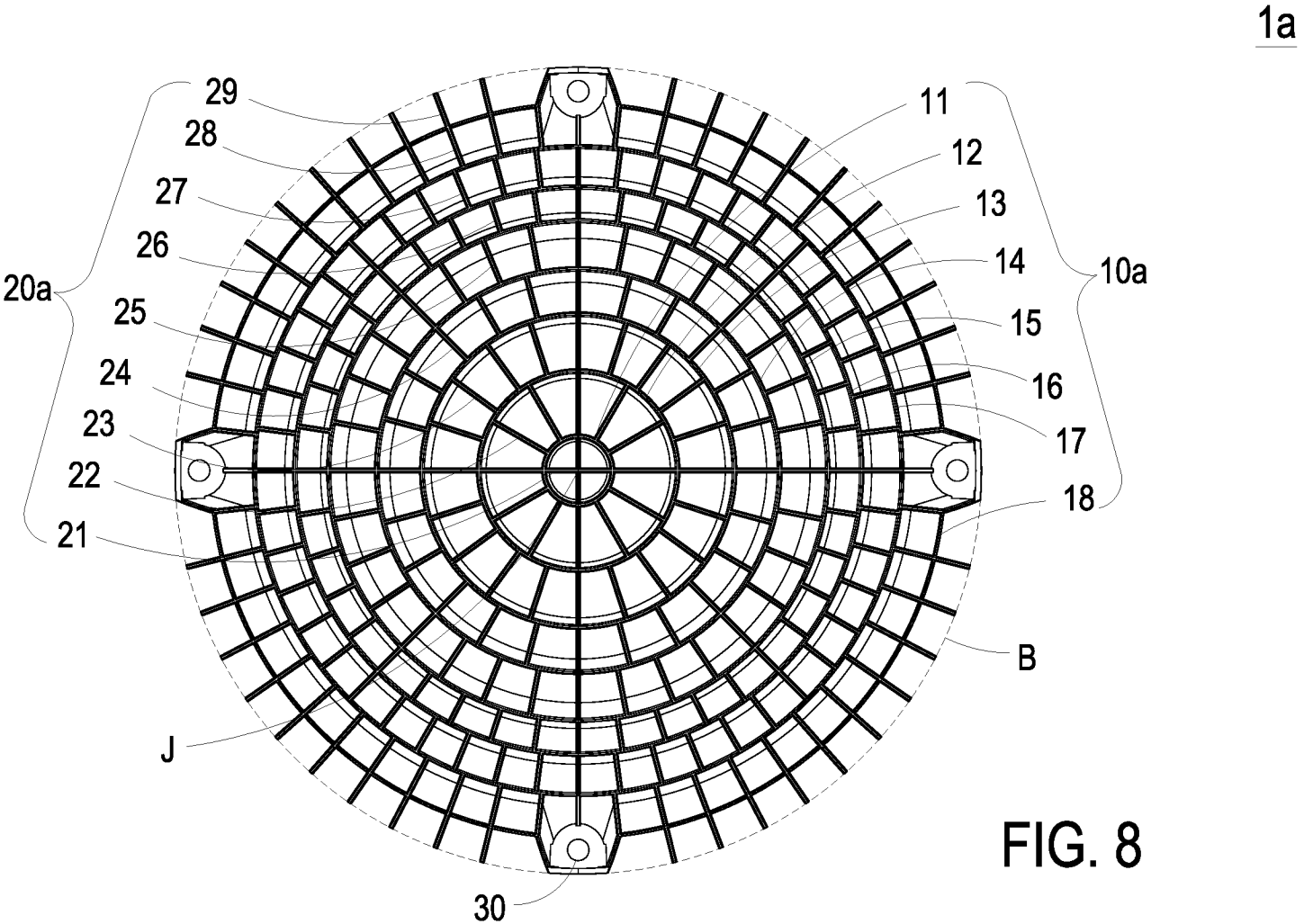
FIG. 8 is a top view illustrating the guiding grid according to the second embodiment of the present disclosure.

FIG. 8 is a top view illustrating the guiding grid according to the second embodiment of the present disclosure. In the embodiment, the guiding grid 1*a* includes four connection elements 30, which are spatially corresponding to the central axis J, disposed on the bottom surface B and equally spaced apart around the central axis J. Preferably but not exclusively, the four connection elements 30 are spatially corresponding to the central axis J, and connected to the central axis J through the plurality of radial elements 21, 22, 23, 24, 25, 26, 27, 28, 29 along the radial direction. The plurality of radial elements 21, 22, 23, 24, 25, 26, 27, 28, 29 are sequentially connected between the central axis J and the connection element 30 and arranged in a straight line. When the guiding grid 1*a* is fastened on the inlet of the fan, sufficient compressive strength is provided to maintain the stability of the entire structure, and the flow field is evenly divided into four quadrant flow fields to increase the reliability of the product. On the other hand, the plurality of radial elements 21, 22, 23, 24, 25, 26, 27, 28, 29 connected to the circumferential elements 10*a* are increased in number from the inside to the outside along the radial direction. Therefore, at least one of the radial elements 20*a* is misaligned and discontinuous in the radial direction. Preferably, at least 50% of the radial elements 20*a* are misaligned and discontinuous in the radial direction, to form an asymmetric structure. It has advantages of providing the function of guiding, dispersing the blade-passage frequency (BPF), and reducing the generation of high-frequency noise. Certainly, the increasing number of the radial elements 20*a* along the radial direction and the misaligned arrangement are adjustable according to the practical requirements. The present disclosure is not limited thereto.

Figure 9:
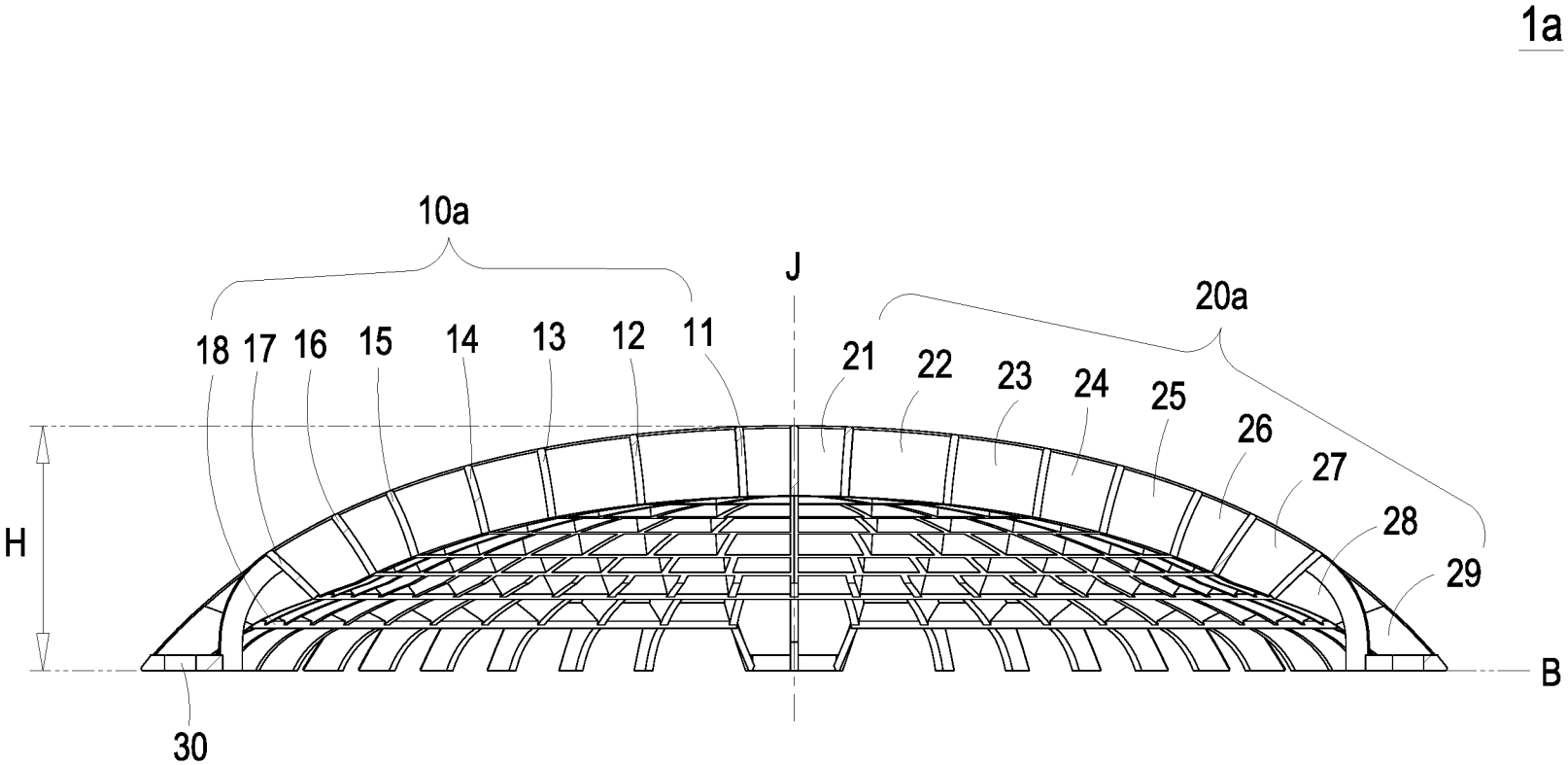
FIG. 9 is a cross-section view illustrating the guiding grid according to the second embodiment of the present disclosure.

FIG. 9 is a cross-section view illustrating the guiding grid according to the second embodiment of the present disclosure. In the embodiment, the plurality of circumferential elements 11, 12, 13, 14, 15, 16, 17, 18 are spaced apart from each other in the radial direction, and form different heights relative to the bottom surface B in the side direction perpendicular to the central axis J. One of the circumferential elements 10*a*, the circumferential element 11, forms a top height H. Preferably but not exclusively, the plurality of circumferential element 11, 12, 13, 14, 15, 16, 17 are reduced in height relative to the bottom surface B along the radial direction. In the embodiment, the plurality of radial elements 21, 22, 23, 24, 25, 26, 27, 28, 29 sequentially connected to the plurality of circumferential elements, 11, 12, 13, 14, 15, 16, 17, 18 from inside to outside, and form a continuous curve or a plurality of connected lines. The present disclosure is not limited thereto. Moreover, in the embodiment, each of the plurality of circumferential elements 11, 12, 13, 14, 15, 16, 17, 18 has an inclination angle relative to the central axis J. Preferably but not exclusively, the circumferential element 11 close to the central axis J forms an inclination angle, which is approximately 0 degrees, and the circumferential element 18 far from the central axis J form an inclination angle horizontal but less than 90 degrees. In other words, the inclination angles of the plurality of circumferential elements 10*a* are increased along the radial direction, and the inclination angles are greater than or equal to 0° and less than 90°.

Figure 10:
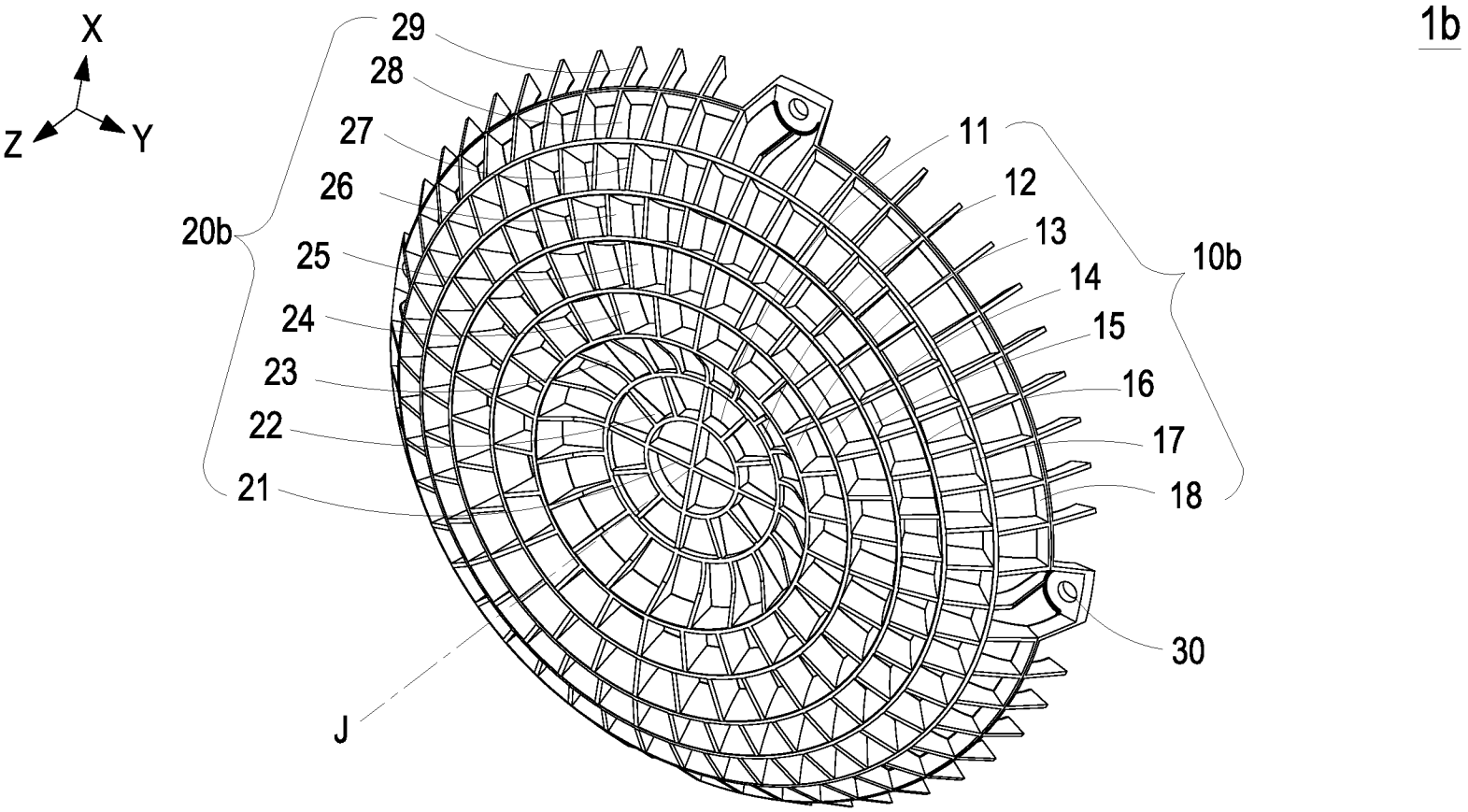
FIG. 10 is a perspective view illustrating a guiding grid according to a third embodiment of the present disclosure.

FIG. 10 is a perspective view illustrating a guiding grid according to a third embodiment of the present disclosure. In the embodiment, the structures, elements and functions of the guiding grid 1*b* are similar to those of guiding grid 1 of FIGS. 1 to 5, and are not redundantly described herein. In the embodiment, the guiding grid 1*b* includes a plurality of circumferential elements 10*b* and a plurality of radial elements 20*b*. Preferably but not exclusively, the plurality of circumferential elements 10*b* includes eight ring-shape circumferential elements 11, 12, 13, 14, 15, 16, 17, 18, which are disposed concentrically from inside to outside relative to the central axis J. The plurality of radial elements 20*b* are connected between each of two adjacent circumferential elements 11, 12, 13, 14, 15, 16, 17, 18. Preferably but not exclusively, in the embodiment, the plurality of circumferential elements 10*b* and the plurality of radial elements 20*b* have the same thickness and are integrally formed in to one piece. Each of two adjacent circumferential elements 10*b* have the radial elements 20*b* correspondingly connected therebetween in a straight line or a curved line. In the embodiment, the guiding grid 1*b* further includes a plurality of connection elements 30. Preferably but not exclusively, the plurality of connection elements 30 are in the shape of the locking hole, and the guiding grid 1*b* is fastened on the fan frame of the centrifugal fan through the connection elements 30 and in contact with the inlet of the fan. In the embodiment, the connection elements 30 are connected to the circumferential elements 17, 18 through the radial elements 28, 29. The plurality of radial elements 21, 22, 23, 24, 25, 26, 27, 28, 29 are increased in number from the central axis J along the radial direction so as to provide more stable structural support and a uniform and stable flow field. Certainly, the numbers of the circumferential elements 10*b* and the radial elements 20*b* are adjustable according to the practical requirements. The present disclosure is not limited thereto.

Figure 11:
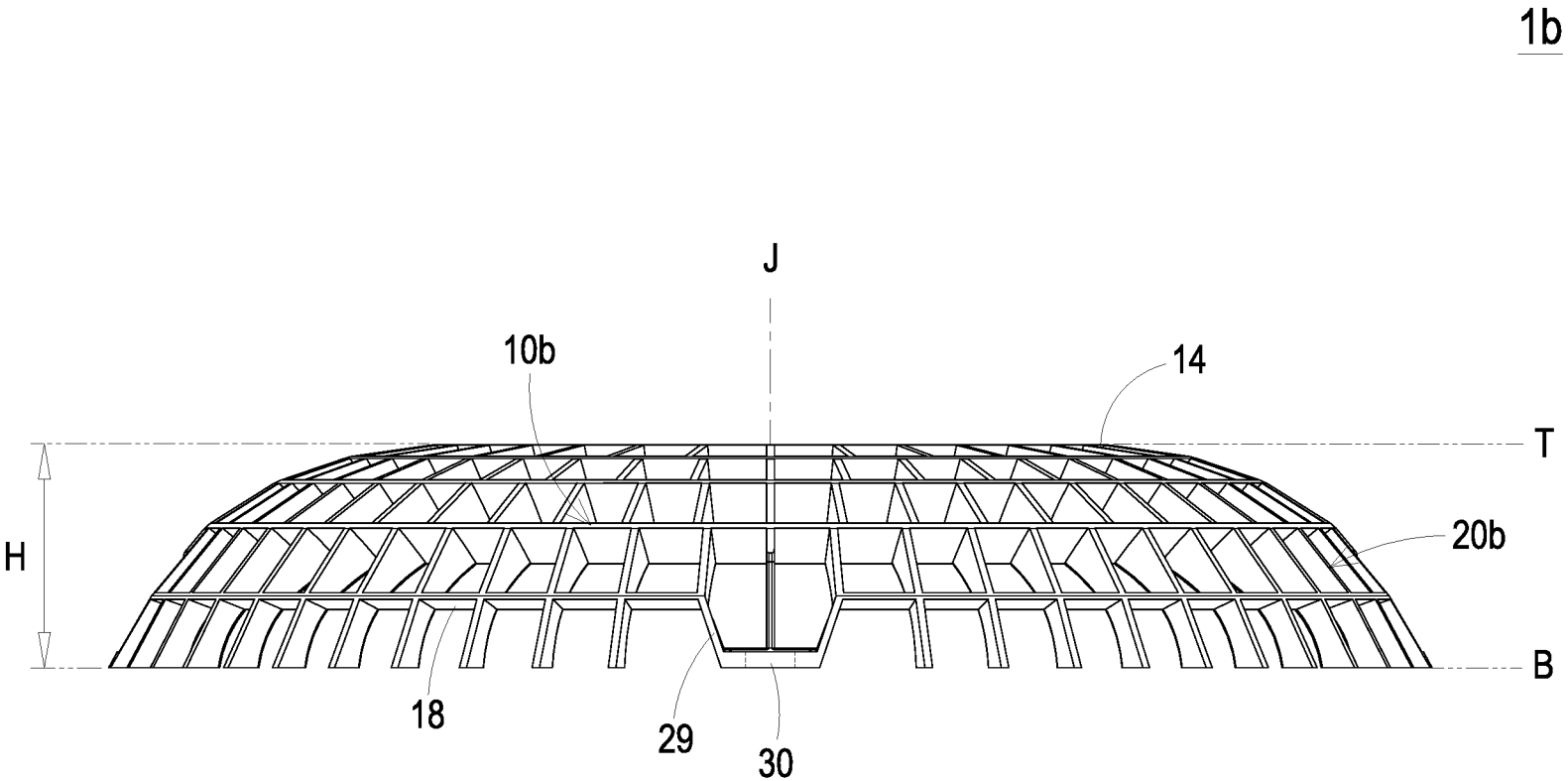
FIG. 11 is a lateral view illustrating the guiding grid according to the third embodiment of the present disclosure.

FIG. 11 is a lateral view illustrating the guiding grid according to the third embodiment of the present disclosure. In the embodiment, the connection elements 30 are configured to fasten the guiding grid 1*b* to the fan. The positions where the connection elements 30 are located can be defined as the bottom surface B of the guiding grid 1*b*. In the embodiment, a farthest one of the circumferential elements 10*b* away from the central axis J is the circumferential element 18, which is connected to the bottom surface B through the corresponding radial element 29. In the embodiment, the plurality of circumferential elements 10*b* are spaced apart from each other along the radial direction, and further form different heights relative to the bottom surface B in a side direction perpendicular to the central axis J. In the embodiment, the circumferential element 14 disposed on the top T of the guiding grid 1*b* forms a top height H.

Figure 12:
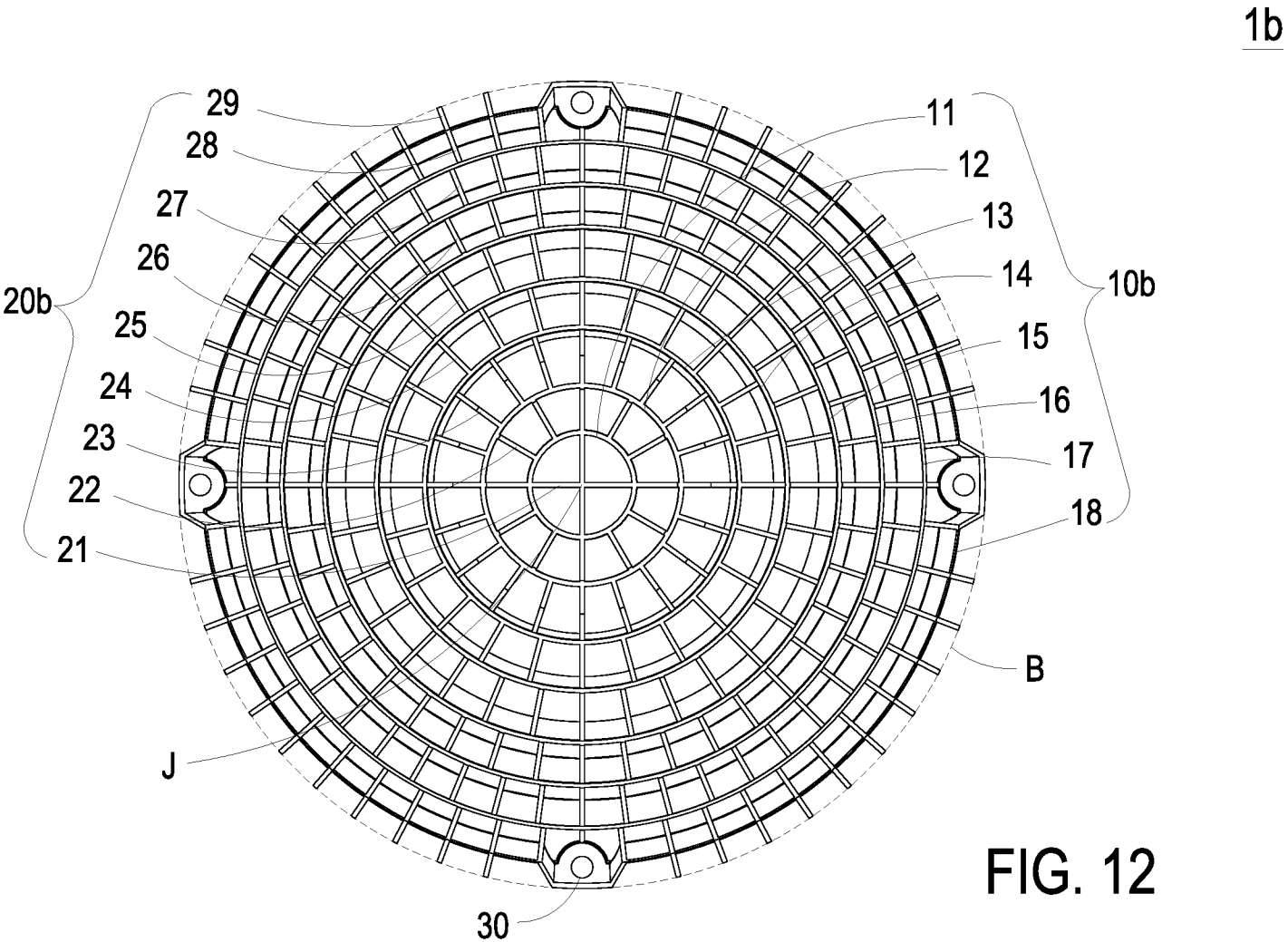
FIG. 12 is a top view illustrating the guiding grid according to the third embodiment of the present disclosure.

FIG. 12 is a top view illustrating the guiding grid according to the third embodiment of the present disclosure. In the embodiment, the guiding grid 1*b* includes four connection elements 30, which are spatially corresponding to the central axis J, disposed on the bottom surface B and equally spaced apart around the central axis J. Preferably but not exclusively, the four connection elements 30 are spatially corresponding to the central axis J, and connected to the central axis J through the plurality of radial elements 21, 22, 23, 24, 25, 26, 27, 28, 29 along the radial direction. The plurality of radial elements 21, 22, 23, 24, 25, 26, 27, 28, 29 are sequentially connected between the central axis J and the connection element 30 and arranged in a straight line. When the guiding grid 1*b* is fastened on the inlet of the fan, sufficient compressive strength is provided to maintain the stability of the entire structure, and the flow field is evenly divided into four quadrant flow fields to increase the reliability of the product. On the other hand, the plurality of radial elements 21, 22, 23, 24, 25, 26, 27, 28, 29 connected to the circumferential elements 10*b* are increased in number from the inside to the outside along the radial direction. Therefore, at least one of the radial elements 20*b* is misaligned and discontinuous in the radial direction. Preferably, at least 50% of the radial elements 20*b* are misaligned and discontinuous in the radial direction, to form an asymmetric structure. It has advantages of providing the function of guiding, dispersing the blade-passage frequency (BPF), and reducing the generation of high-frequency noise. Certainly, the increasing number of the radial elements 20*b* along the radial direction and the misaligned arrangement are adjustable according to the practical requirements. The present disclosure is not limited thereto.

Figure 13:
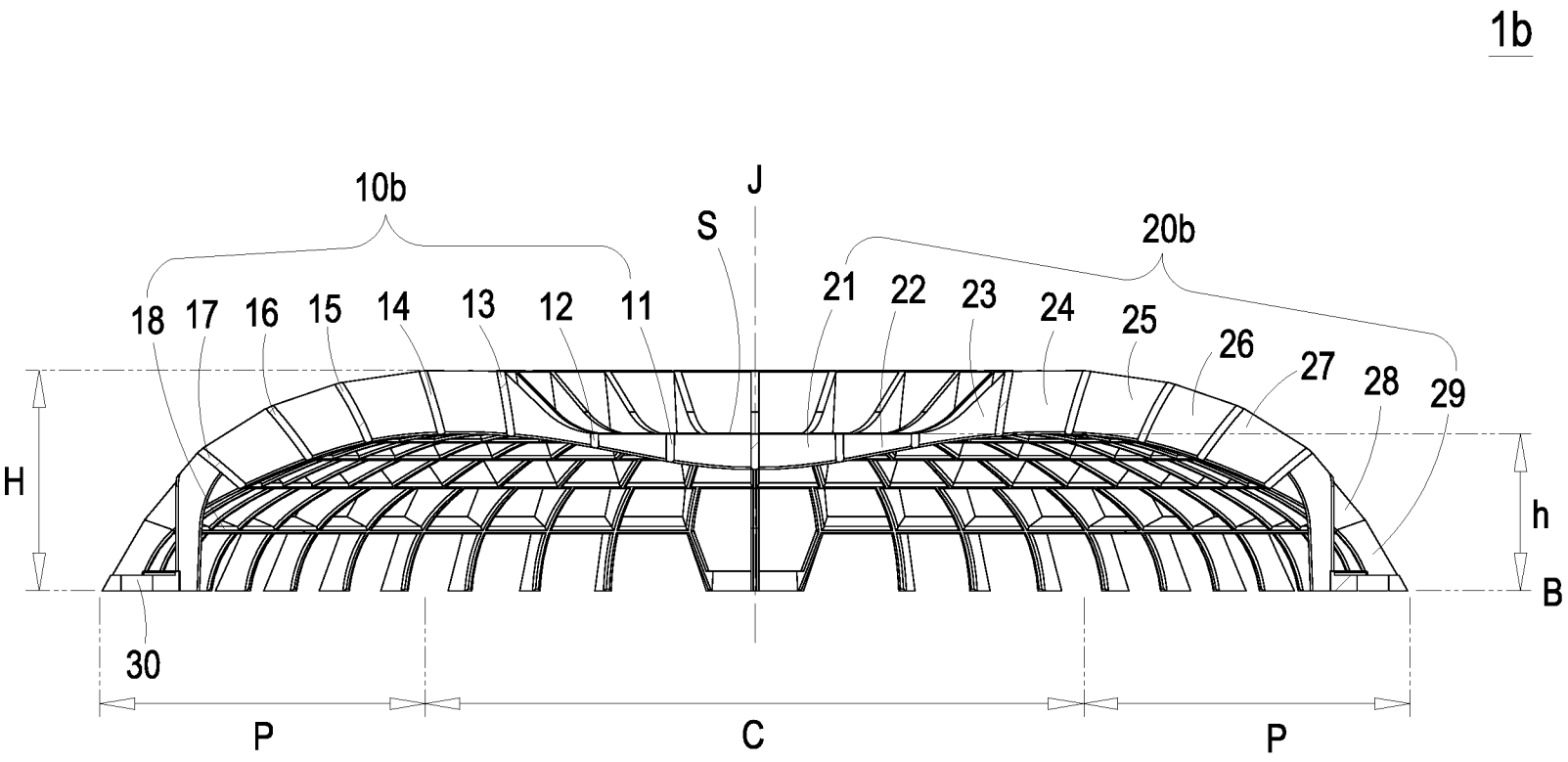
FIG. 13 is a cross-section view illustrating the guiding grid according to the third embodiment of the present disclosure.

FIG. 13 is a cross-section view illustrating the guiding grid according to the third embodiment of the present disclosure. In the embodiment, the plurality of circumferential elements 11, 12, 13, 14, 15, 16, 17, 18 are spaced apart from each other in the radial direction, and form different heights relative to the bottom surface B in the side direction perpendicular to the central axis J. One of the circumferential elements 10*b*, the circumferential element 14, forms a top height H, so that the circumferential elements 10*b* are divided into an outer-ring region P and a central region C by the circumferential element 14. The plurality of circumferential elements 11, 12, 13 located in the central region C are increased in height relative to the bottom surface B from the central axis J along the radial direction. Some of the plurality of circumferential elements 10*b*, such as the circumferential elements 11, 12, and some of the plurality of radial elements 20*b*, such as the radial elements 21, 22 further collaboratively form a concave plane S, which has a central height h relative to the bottom surface B, and the central height h is less than the top height H. The plurality of circumferential element 15, 16, 17, 18 located in the outer ring region P are reduced in height relative to the bottom surface B along the radial direction. Moreover, in the embodiment, the plurality of radial elements 21, 22, 23, 24, 25, 26, 27, 28, 29 sequentially connected to the plurality of circumferential elements, 11, 12, 13, 14, 15, 16, 17, 18 from inside to outside, and form a continuous curve or a plurality of connected lines. The present disclosure is not limited thereto. In the embodiment, the plurality of circumferential element 10*b* have inclination angles relative to the central axis J, respectively. Preferably but not exclusively, the inclination angles of the plurality of circumferential elements 10*b* are increased along the radial direction, and the inclination angles are greater than or equal to 0° and less than 90°.

Figure 14:
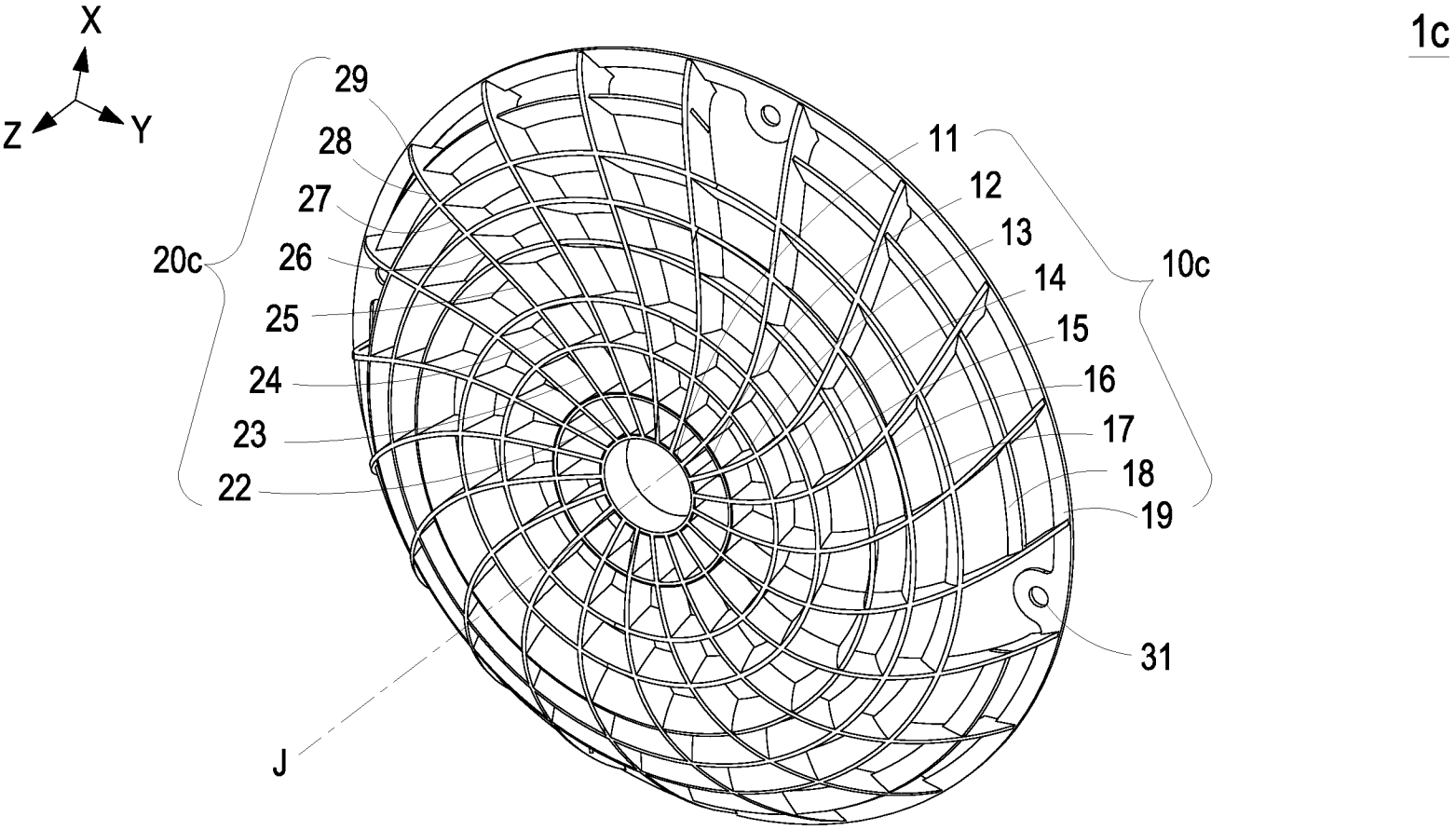
FIG. 14 is a perspective view illustrating a guiding grid according to a fourth embodiment of the present disclosure.

FIG. 14 is a perspective view illustrating a guiding grid according to a fourth embodiment of the present disclosure. In the embodiment, the structures, elements and functions of the guiding grid 1*c* are similar to those of guiding grid 1 of FIGS. 1 to 5, and are not redundantly described herein. In the embodiment, the guiding grid 1*c* includes a plurality of circumferential elements 10*c* and a plurality of radial elements 20*c*. Preferably but not exclusively, the plurality of circumferential elements 10*c* includes nine ring-shape circumferential element 11, 12, 13, 14, 15, 16, 17, 18, 19, which are disposed concentrically from inside to outside relative to a central axis J. The plurality of radial elements 20*c* are connected between each of two adjacent circumferential elements 11, 12, 13, 14, 15, 16, 17, 18, 19, and disconnected with the central axis J in the radial direction. Namely, a hollow region is formed inside the circumferential elements 11. That is, the central axis J does not pass through any one of the circumferential elements 10*c* or the radial elements 20*c*. Preferably but not exclusively, in the embodiment, the plurality of circumferential elements 10*c* and the plurality of radial elements 20*c* have the same thickness and are integrally formed in to one piece. In the embodiment, the guiding grid 1*c* further includes a plurality of connection elements 31. Preferably but not exclusively, the plurality of connection elements 31 are in the shape of the locking hole, and the guiding grid 1*c* is fastened on the fan frame of the centrifugal fan through the connection elements 31 and in contact with the inlet of the fan. In the embodiment, the connection elements 31 are connected to each other through the circumferential elements 19, but not directly connected to the radial elements 20*c*. Moreover, the plurality of radial elements 20*c* are not parallel to the radial direction. In the embodiment, the plurality of radial elements 22, 23, 24, 25, 26, 27, 28, 29 are successively connected with the plurality of circumferential elements 11, 12, 13, 14, 15, 16, 17, 18, 19 from inside to outside, and form a continuous curve.

Figure 15:
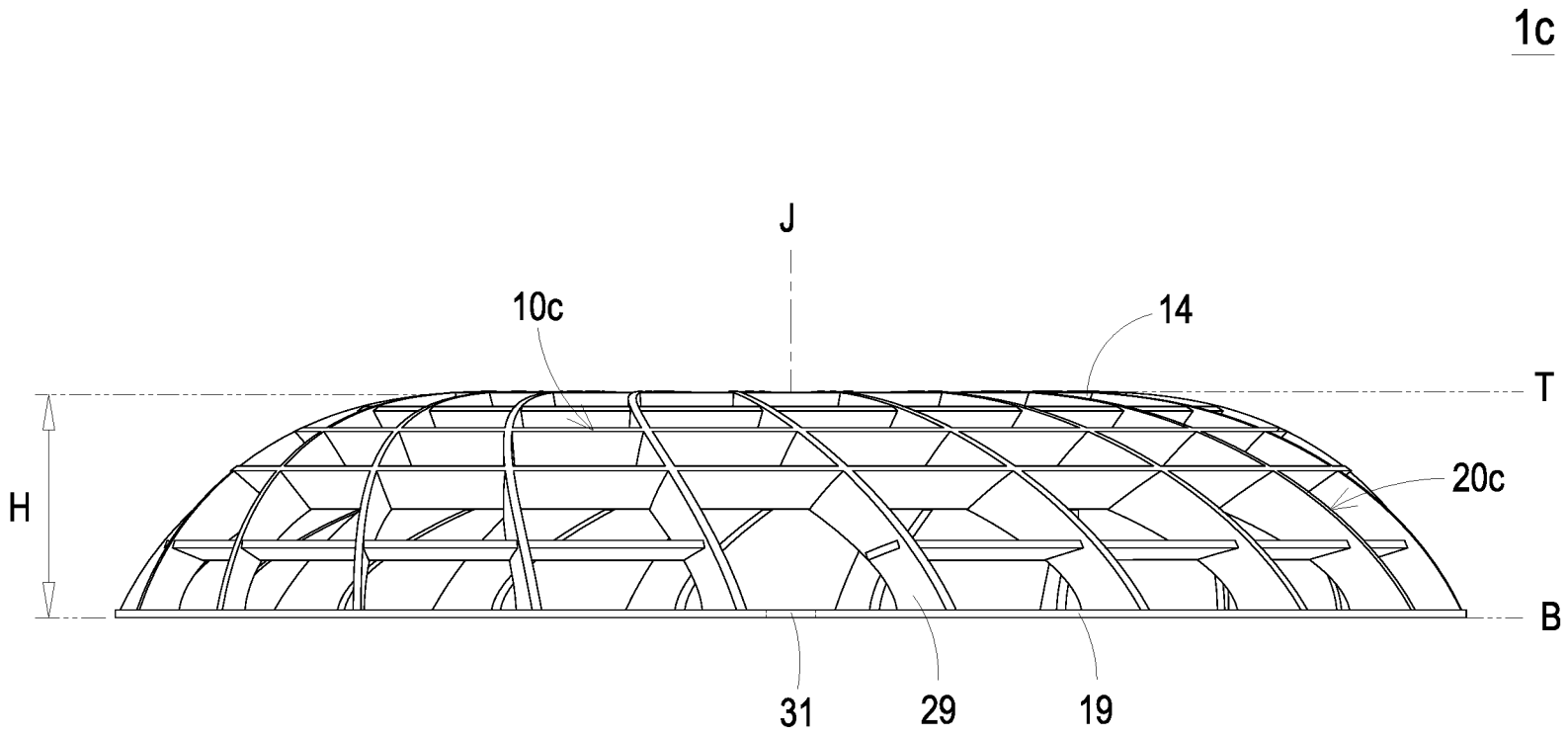
FIG. 15 is a lateral view illustrating the guiding grid according to the fourth embodiment of the present disclosure.

FIG. 15 is a lateral view illustrating the guiding grid according to the fourth embodiment of the present disclosure. In the embodiment, the connection elements 31 are configured to fasten the guiding grid 1*c* to the fan. The positions where the connection elements 31 are located can be defined as the bottom surface B of the guiding grid 1*c*. In the embodiment, a farthest one of the circumferential elements 10*c* away from the central axis J is the circumferential element 19, which is attached to the bottom surface B but not directly connected to the radial elements 20*c*. In the embodiment, the plurality of circumferential elements 10*c* are spaced apart from each other along the radial direction, and further form different heights relative to the bottom surface B in a side direction perpendicular to the central axis J. In the embodiment, the circumferential element 14 disposed on the top T of the guiding grid 1*c* forms a top height H.

Figure 16:
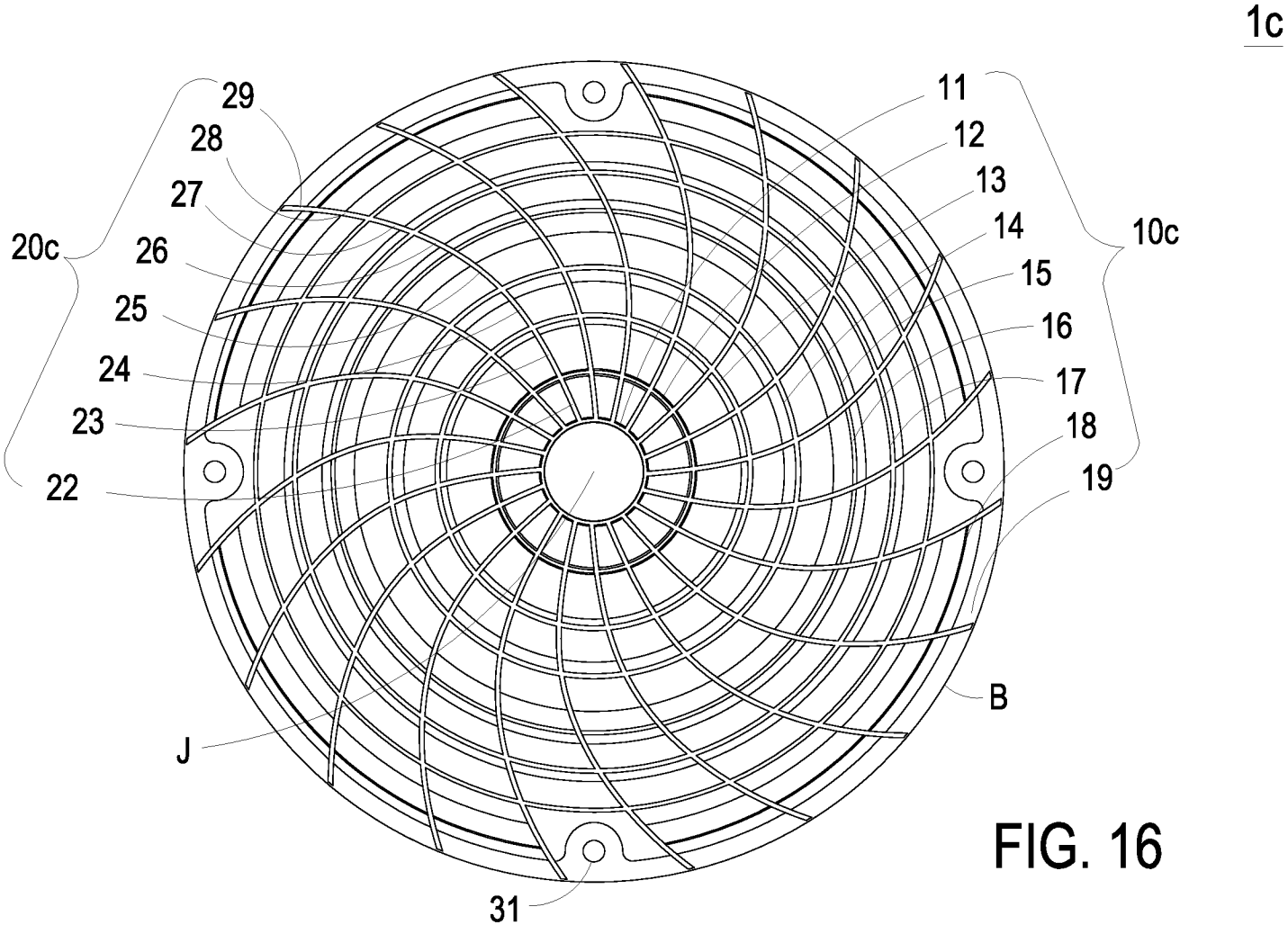
FIG. 16 is a top view illustrating the guiding grid according to the fourth embodiment of the present disclosure.

FIG. 16 is a top view illustrating the guiding grid according to the fourth embodiment of the present disclosure. In the embodiment, the guiding grid 1*c* includes four connection elements 31, which are spatially corresponding to the central axis J, disposed on the bottom surface B and equally spaced apart around the central axis J. In the embodiment, each of the connection elements 31 has a through hole for fastening the guiding grid 1*c*. Preferably but not exclusively, none of the four connection elements 31 intersects the radial elements 22, 23, 24, 25, 26, 27, 28, 29 in a continuous curve. The radial elements 22, 23, 24, 25, 26, 27, 28, 29 in the continuous curve are extended from the circumferential element 11 to the circumferential element 19 at the bottom surface B. When the guiding grid 1*c* is fastened to the inlet of the fan through the bottom surface B, it facilitates the guiding grid 1*c* to provide sufficient compressive strength and increase the reliability of the product. Certainly, the curved angle along the radial direction and the number of the radial element 20*c* are adjustable according to the practical requirements. The present disclosure is not limited thereto.

Figure 17:
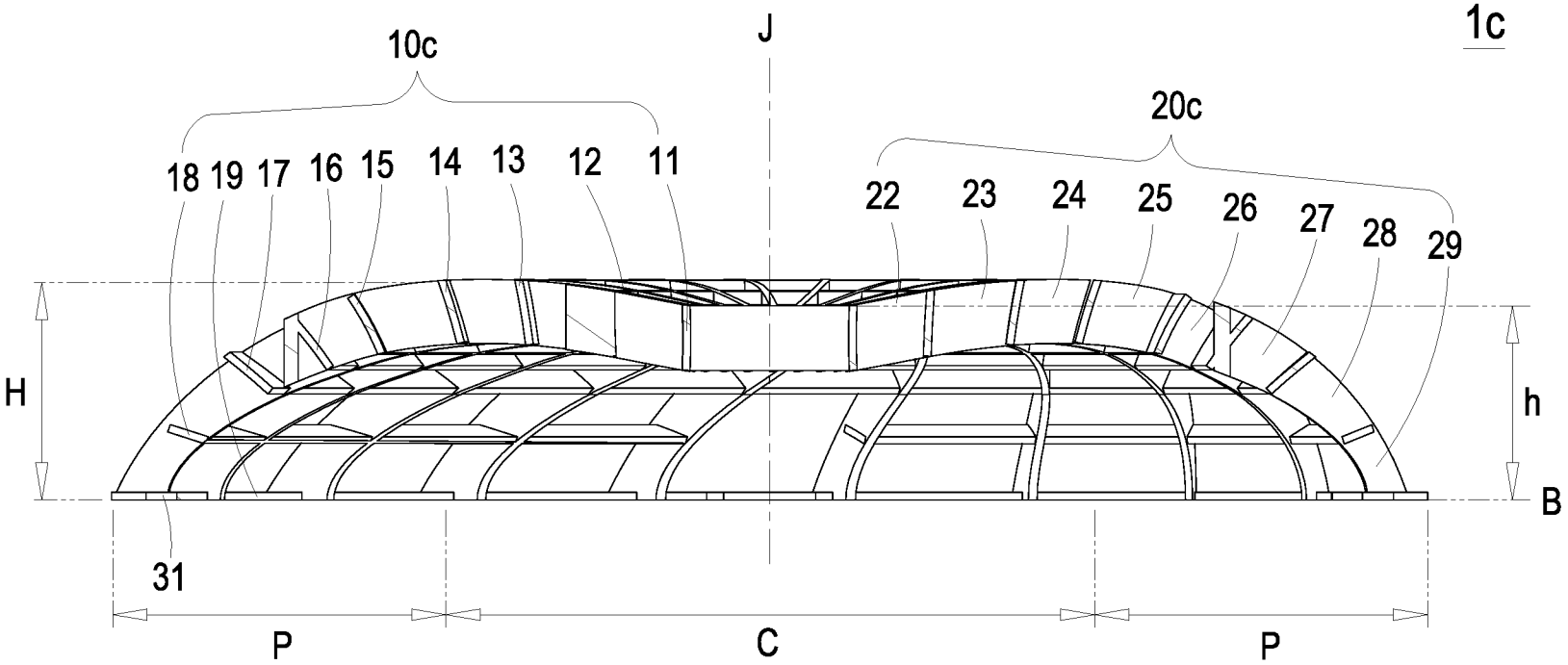
FIG. 17 is a cross-section view illustrating the guiding grid according to the fourth embodiment of the present disclosure.

FIG. 17 is a cross-section view illustrating the guiding grid according to the fourth embodiment of the present disclosure. In the embodiment. In the embodiment, the plurality of circumferential elements 11, 12, 13, 14, 15, 16, 17, 18, 19 are spaced apart from each other in the radial direction, and form different heights relative to the bottom surface B in the side direction perpendicular to the central axis J. One of the circumferential elements 10*c*, the circumferential element 14, forms a top height H. Furthermore, the circumferential elements 10*c* are divided into an outer-ring region P and a central region C by the circumferential element 14. The plurality of circumferential elements 11, 12, 13 located in the central region C are increased in height relative to the bottom surface B from the central axis J along the radial direction. Moreover, a central height h is formed adjacent to the central axis, and the central height h is less than the top height H. The plurality of circumferential element 15, 16, 17, 18, 19 located in the outer ring region P are reduced in height relative to the bottom surface B along the radial direction. Moreover, in the embodiment, the plurality of radial elements 22, 23, 24, 25, 26, 27, 28, 29 sequentially connected to the plurality of circumferential elements, 11, 12, 13, 14, 15, 16, 17, 18, 19 from inside to outside, and form a continuous curve or a plurality of connected lines. The present disclosure is not limited thereto. In the embodiment, the plurality of circumferential element 10*c* have inclination angles relative to the central axis J, respectively. Preferably but not exclusively, the inclination angle of the circumferential element 11 closest to the central axis J is about 0 degree relative to the central axis J. Preferably but not exclusively, the farthest one of the plurality of circumferential elements 10*c*, the circumferential element 19, is horizontal, has the inclination angle about 90° relative to the central axis J, and fits the bottom surface B. In other words, the inclination angles of the plurality of circumferential elements 10*c* are increased along the radial direction, and the inclination angles are ranged from 0° to 90°. Certainly, the present disclosure is not limited thereto.

Figure 18:
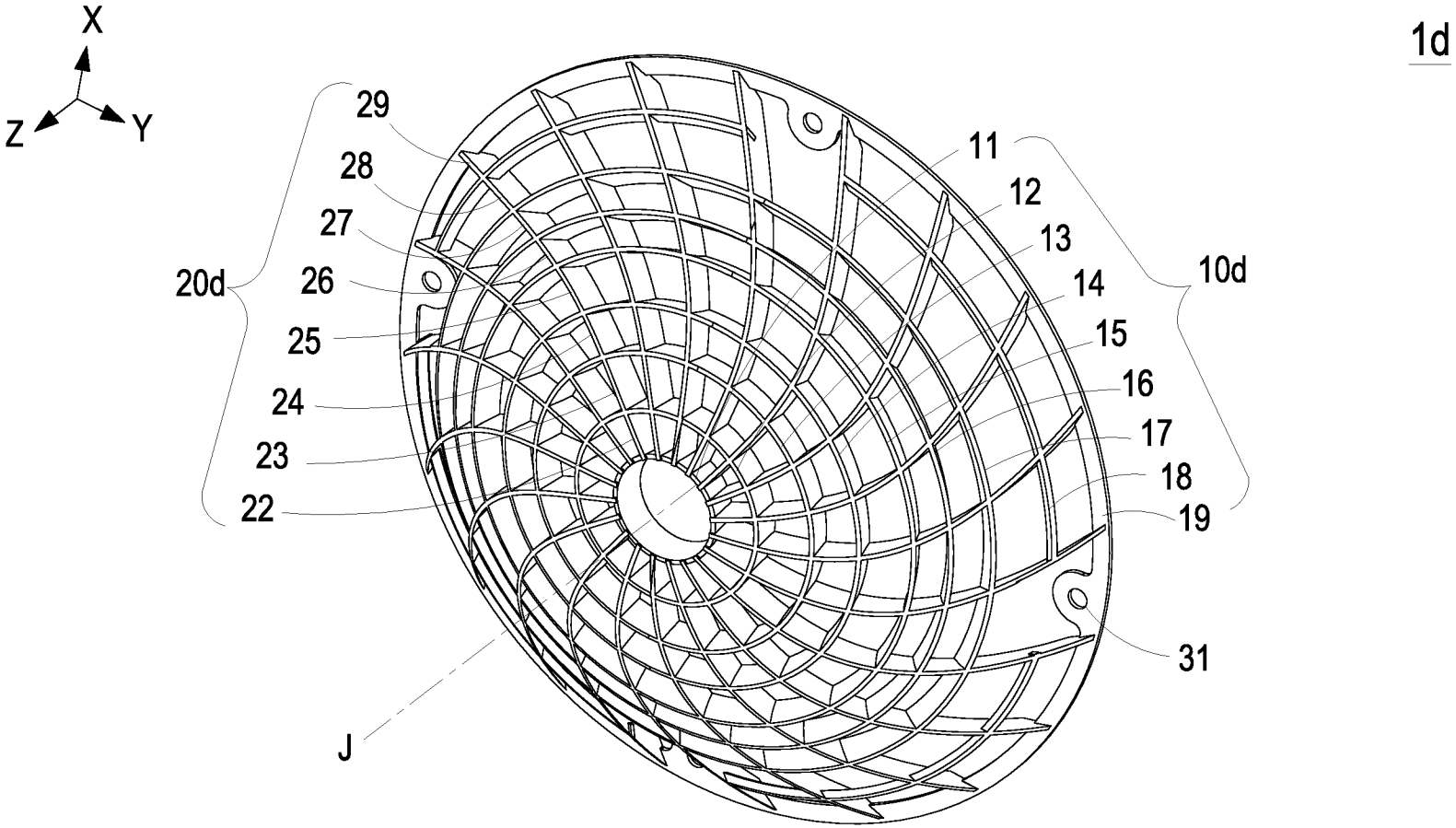
FIG. 18 is a perspective view illustrating a guiding grid according to a fifth embodiment of the present disclosure.

FIG. 18 is a perspective view illustrating a guiding grid according to a fifth embodiment of the present disclosure. In the embodiment, the structures, elements and functions of the guiding grid 1*d* are similar to those of guiding grid 1*c* of FIGS. 14 to 17, and are not redundantly described herein. In the embodiment, the guiding grid 1*d* includes a plurality of circumferential elements 10*d* and a plurality of radial elements 20*d*. Preferably but not exclusively, the plurality of circumferential elements 10*d* includes nine ring-shape circumferential element 11, 12, 13, 14, 15, 16, 17, 18, 19, which are disposed concentrically from inside to outside relative to a central axis J. The plurality of radial elements 20*d* are connected between each of two adjacent circumferential elements 11, 12, 13, 14, 15, 16, 17, 18, 19, and disconnected with the central axis J in the radial direction. Preferably but not exclusively, in the embodiment, the plurality of circumferential elements 10*d* and the plurality of radial elements 20*d* have the same thickness and are integrally formed in to one piece. In the embodiment, the guiding grid 1*d* further includes a plurality of connection elements 31. Preferably but not exclusively, the plurality of connection elements 31 are in the shape of the locking hole, and the guiding grid 1*d* is fastened on the fan frame of the centrifugal fan through the connection elements 31 and in contact with the inlet of the fan. In the embodiment, the connection elements 31 are connected to each other through the circumferential elements 19, but not directly connected to the radial elements 20*d*. Moreover, the plurality of radial elements 20*d* are not parallel to the radial direction. In the embodiment, the plurality of radial elements 22, 23, 24, 25, 26, 27, 28, 29 are successively connected with the plurality of circumferential elements 11, 12, 13, 14, 15, 16, 17, 18, 19 from inside to outside, and form a continuous curve. Certainly, the numbers of the circumferential elements 10*d* and the radial elements 20*d* are adjustable according to the practical requirements. The present disclosure is not limited thereto.

Figure 19:
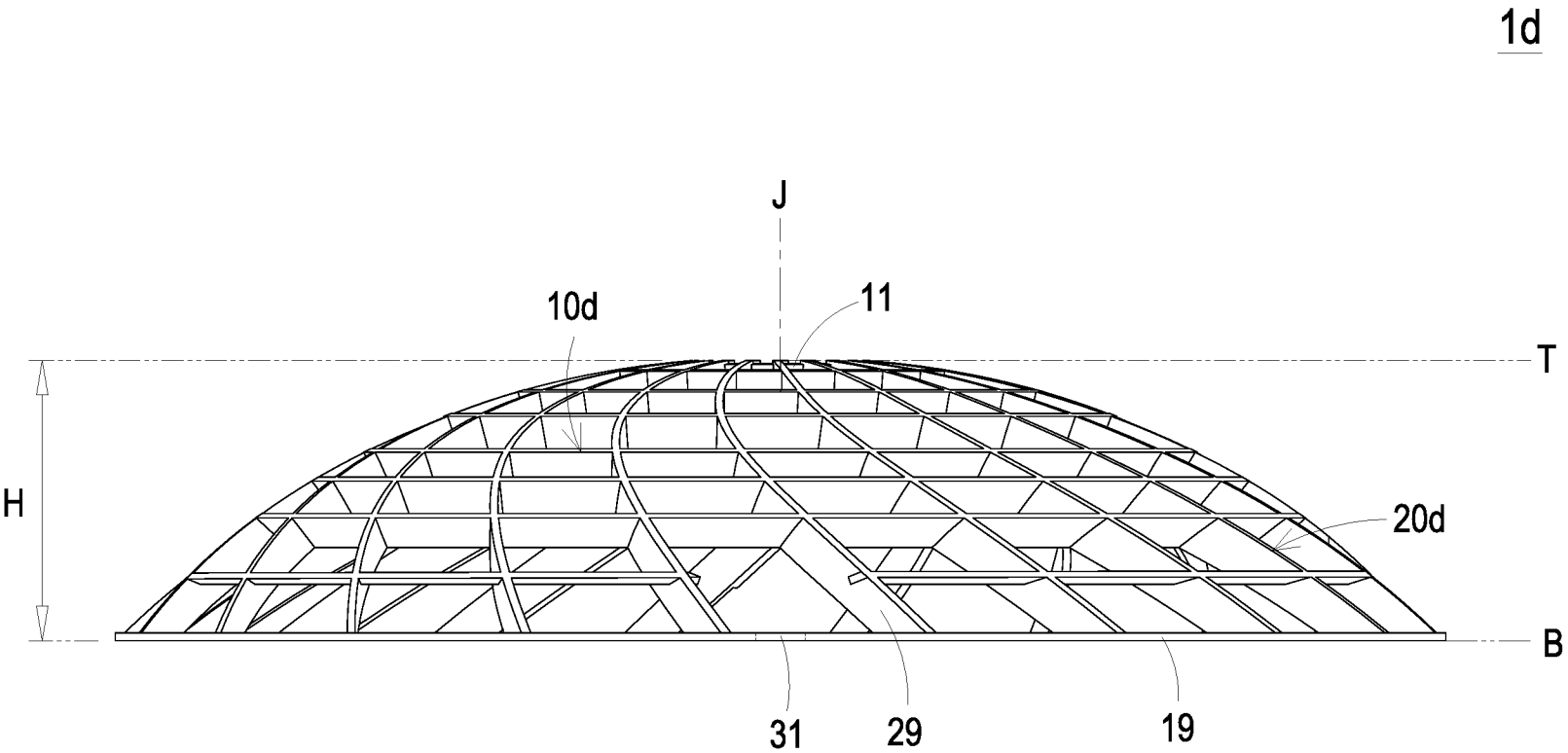
FIG. 19 is a lateral view illustrating the guiding grid according to the fifth embodiment of the present disclosure.

FIG. 19 is a lateral view illustrating the guiding grid according to the fifth embodiment of the present disclosure. In the embodiment, the connection elements 31 are configured to fasten the guiding grid 1*d* to the fan. The positions where the connection elements 31 are located can be defined as the bottom surface B of the guiding grid 1*d*. In the embodiment, a farthest one of the circumferential elements 10*d* away from the central axis J is the circumferential element 19, which is attached to the bottom surface B but not directly connected to the radial elements 20*d*. In the embodiment, the plurality of circumferential elements 10*d* are spaced apart from each other along the radial direction, and further form different heights relative to the bottom surface B in a side direction perpendicular to the central axis J. In the embodiment, the circumferential element 11 disposed on the top T of the guiding grid 1*d* forms a top height H.

Figure 20:
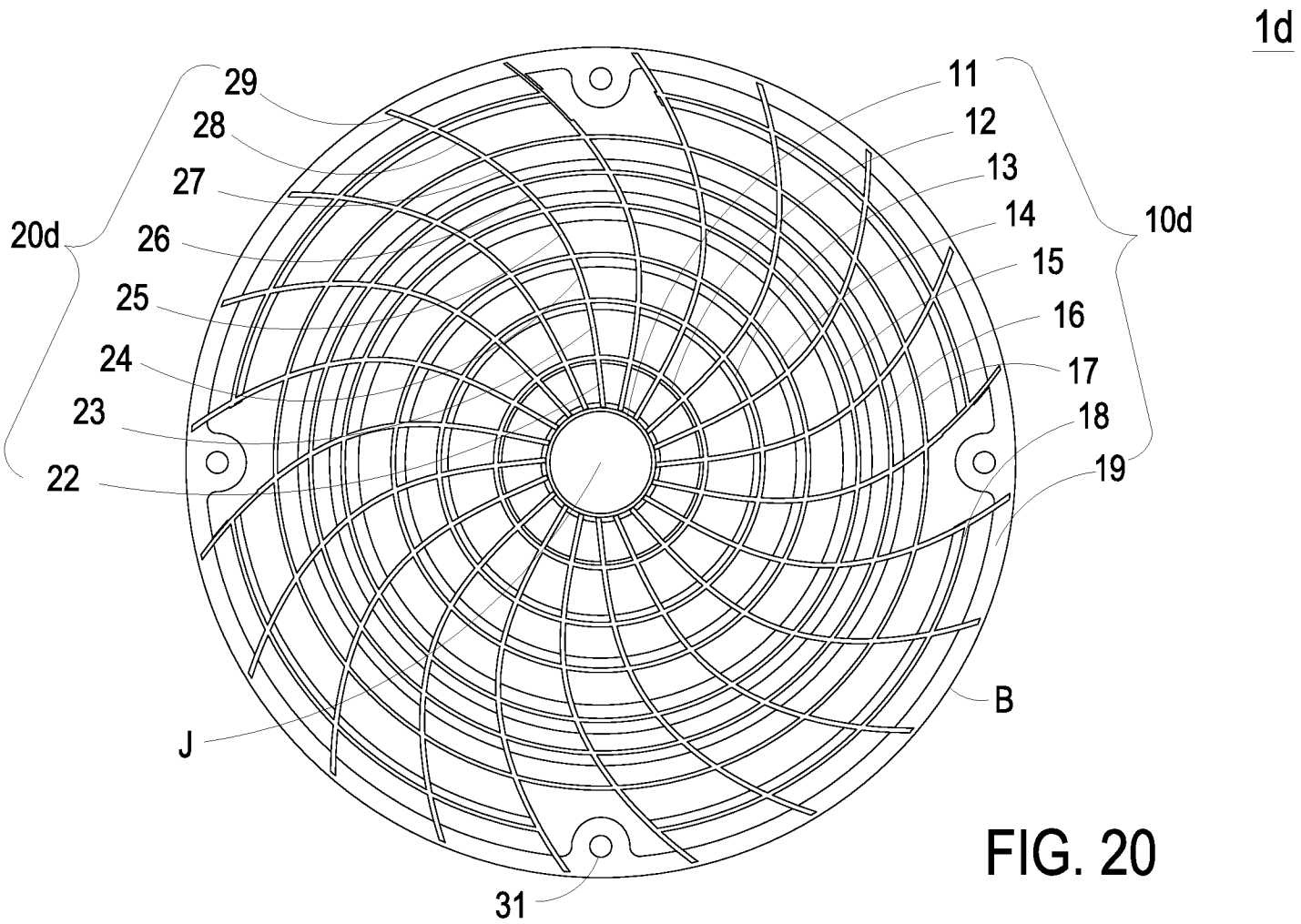
FIG. 20 is a top view illustrating the guiding grid according to the fifth embodiment of the present disclosure.

FIG. 20 is a top view illustrating the guiding grid according to the fifth embodiment of the present disclosure. In the embodiment, the guiding grid 1*d* includes four connection elements 31, which are spatially corresponding to the central axis J, disposed on the bottom surface B and equally spaced apart around the central axis J. In the embodiment, none of the four connection elements 31 intersects the radial elements 22, 23, 24, 25, 26, 27, 28, 29 in a continuous curve. The radial elements 22, 23, 24, 25, 26, 27, 28, 29 in the continuous curve are extended from the circumferential element 11 to the circumferential element 19 at the bottom surface B. When the guiding grid 1*d* is fastened to the inlet of the fan through the bottom surface B, it facilitates the guiding grid 1*d* to provide sufficient compressive strength and increase the reliability of the product. Certainly, the curved angle along the radial direction and the number of the radial element 20*d* are adjustable according to the practical requirements. The present disclosure is not limited thereto.

Figure 21:
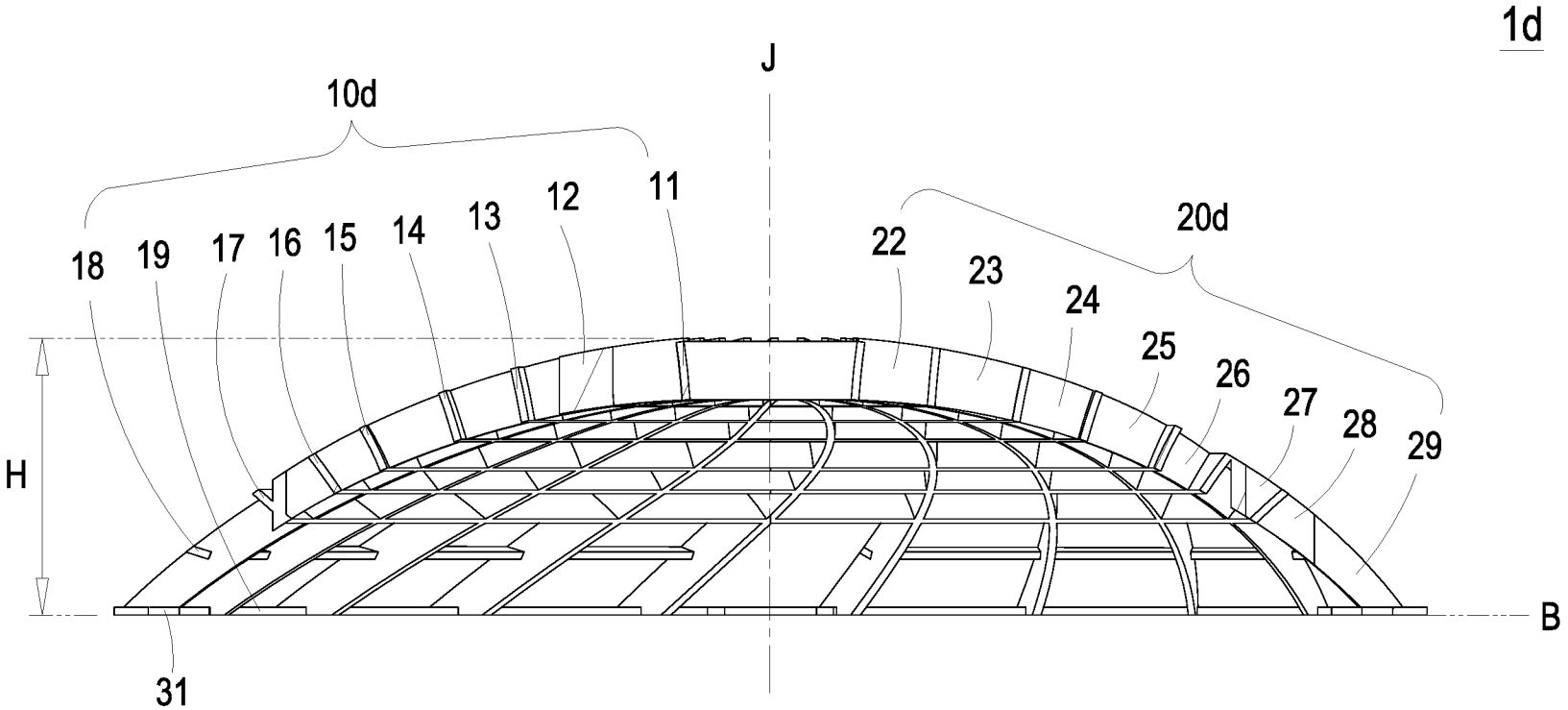
FIG. 21 is a cross-section view illustrating the guiding grid according to the fifth embodiment of the present disclosure.

FIG. 21 is a cross-section view illustrating the guiding grid according to the fifth embodiment of the present disclosure. In the embodiment. In the embodiment, the plurality of circumferential elements 11, 12, 13, 14, 15, 16, 17, 18, 19 are spaced apart from each other in the radial direction, and form different heights relative to the bottom surface B in the side direction perpendicular to the central axis J. One of the circumferential elements 10*d*, the circumferential element 11, forms a top height H. Furthermore, the plurality of circumferential element 11, 12, 13, 14, 15, 16, 17, 18, 19 are reduced in height relative to the bottom surface B along the radial direction. In the embodiment, the plurality of radial elements 22, 22, 23, 24, 25, 26, 27, 28, 29 sequentially connected to the plurality of circumferential elements, 11, 12, 13, 14, 15, 16, 17, 18, 19 from inside to outside, and form a continuous curve or a plurality of connected lines. The present disclosure is not limited thereto. In the embodiment, the plurality of circumferential element 11, 12, 13, 14, 15, 16, 17, 18, 19 have inclination angles relative to the central axis J, respectively. Preferably but not exclusively, the inclination angle of the circumferential element 11 closest to the central axis J is about 0 degree relative to the central axis J. Preferably but not exclusively, the farthest one of the plurality of circumferential elements 10*d*, the circumferential element 19, is horizontal, has the inclination angle about 90° relative to the central axis J, and fits the bottom surface B. In other words, the inclination angles of the plurality of circumferential elements 10*d* are increased along the radial direction, and the inclination angles are ranged from 0° to 90°. Certainly, the present disclosure is not limited thereto.

Figure 22:
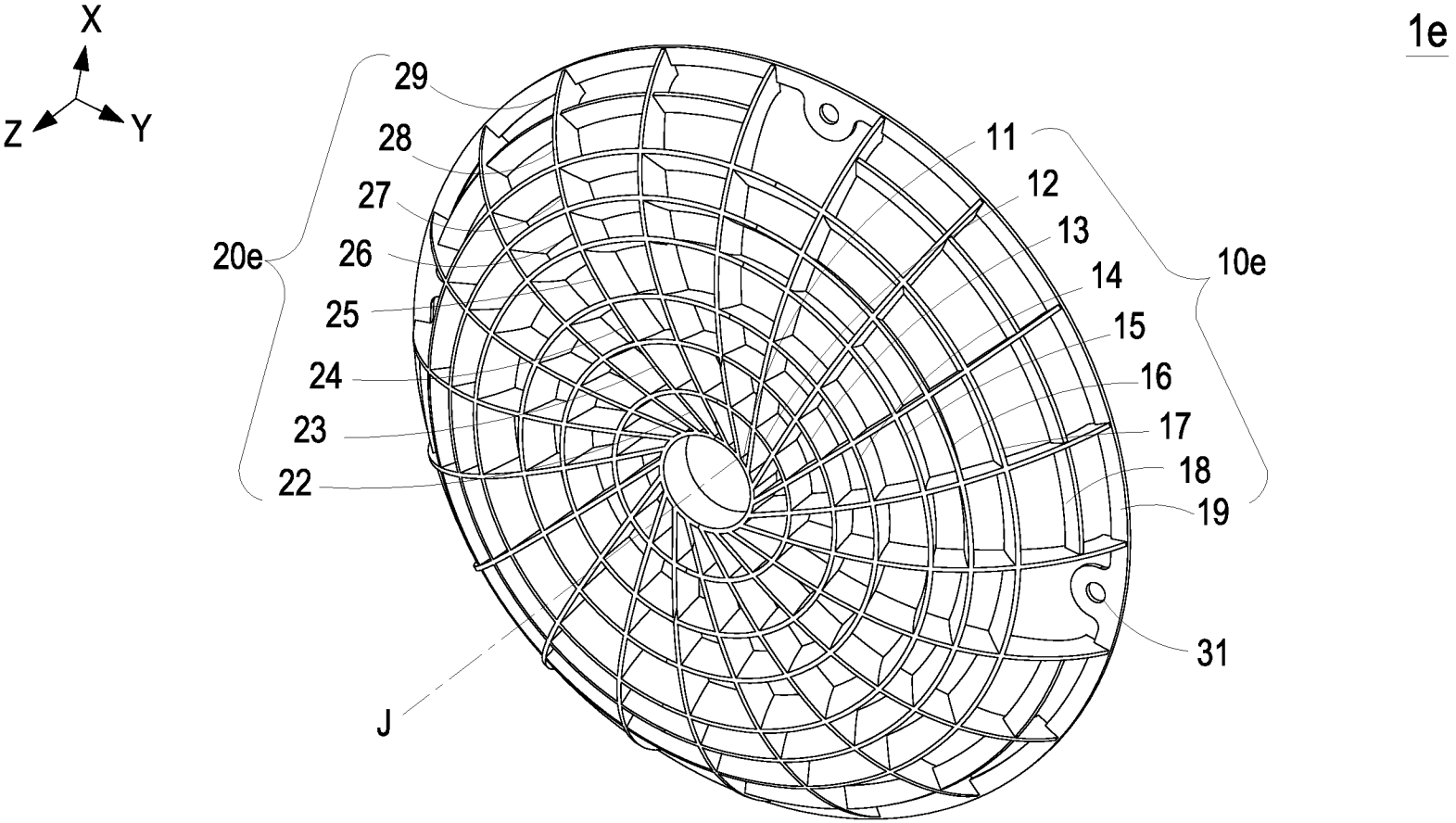
FIG. 22 is a perspective view illustrating a guiding grid according to a sixth embodiment of the present disclosure.

FIG. 22 is a perspective view illustrating a guiding grid according to a sixth embodiment of the present disclosure. In the embodiment, the structures, elements and functions of the guiding grid 1*e* are similar to those of guiding grid 1*c* of FIGS. 14 to 17, and are not redundantly described herein. In the embodiment, the guiding grid 1*e* includes a plurality of circumferential elements 10*e* and a plurality of radial elements 20*e*. Preferably but not exclusively, the plurality of circumferential elements 10*e* includes nine ring-shape circumferential element 11, 12, 13, 14, 15, 16, 17, 18, 19, which are disposed concentrically from inside to outside relative to a central axis J. The plurality of radial elements 20*e* are connected between each of two adjacent circumferential elements 11, 12, 13, 14, 15, 16, 17, 18, 19, and disconnected with the central axis J in the radial direction. Preferably but not exclusively, in the embodiment, the plurality of circumferential elements 10*e* and the plurality of radial elements 20*e* have the same thickness and are integrally formed in to one piece. In the embodiment, the guiding grid 1*e* further includes a plurality of connection elements 31. Preferably but not exclusively, the plurality of connection elements 31 are in the shape of the locking hole, and the guiding grid 1*e* is fastened on the fan frame of the centrifugal fan through the connection elements 31 and in contact with the inlet of the fan. In the embodiment, the connection elements 31 are connected to each other through the circumferential elements 19, but not directly connected to the radial elements 20*e*. Moreover, the plurality of radial elements 20*e* are not parallel to the radial direction. In the embodiment, the plurality of radial elements 22, 23, 24, 25, 26, 27, 28, 29 are successively connected with the plurality of circumferential elements 11, 12, 13, 14, 15, 16, 17, 18, 19 from inside to outside, and form a continuous straight line. Certainly, the numbers of the circumferential elements 10*e* and the radial elements 20*e* are adjustable according to the practical requirements. The present disclosure is not limited thereto.

Figure 23:
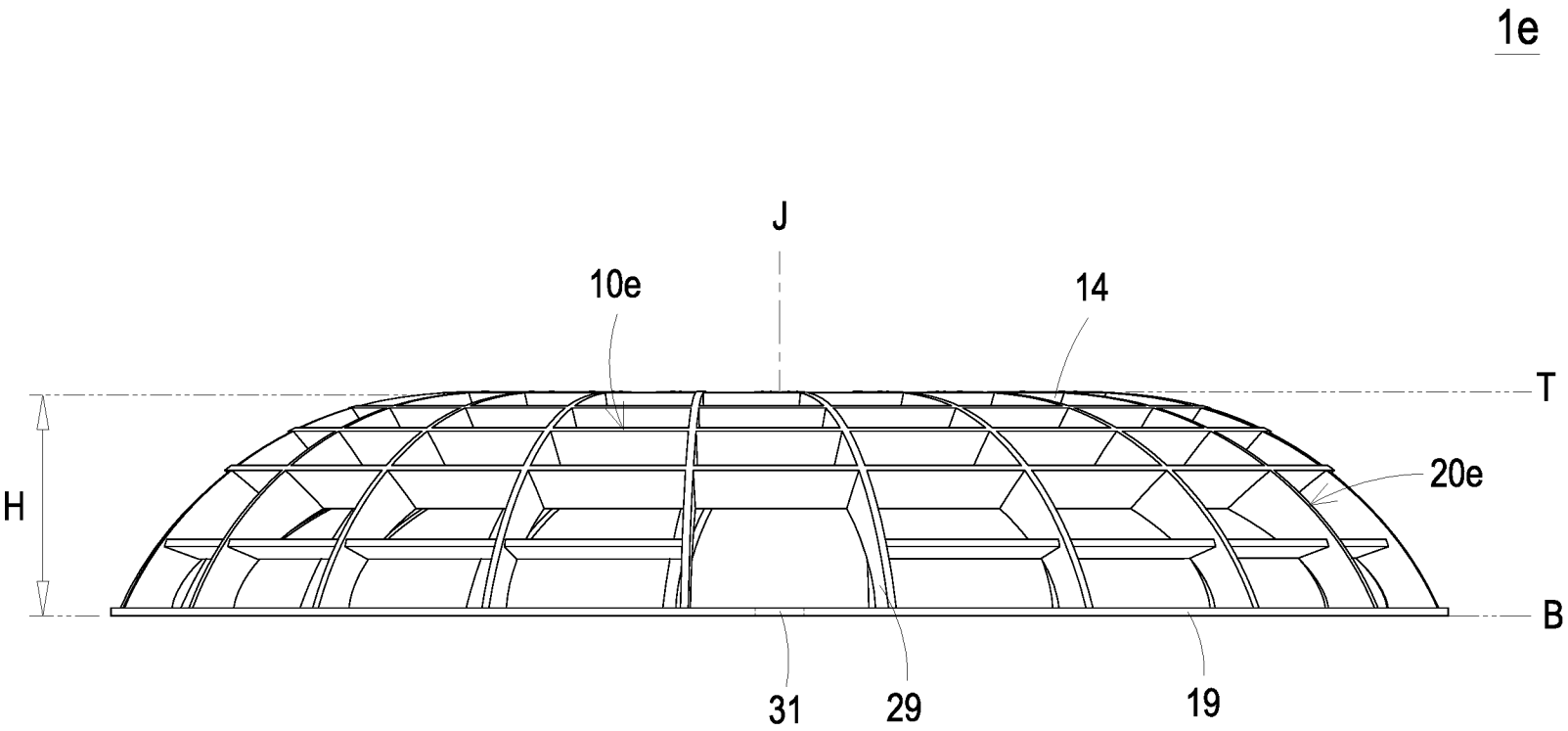
FIG. 23 is a lateral view illustrating the guiding grid according to the sixth embodiment of the present disclosure.

FIG. 23 is a lateral view illustrating the guiding grid according to the sixth embodiment of the present disclosure. In the embodiment, the connection elements 31 are configured to fasten the guiding grid 1*e* to the fan. The positions where the connection elements 31 are located can be defined as the bottom surface B of the guiding grid 1*e*. In the embodiment, a farthest one of the circumferential elements 10*e* away from the central axis J is the circumferential element 19, which is attached to the bottom surface B but not directly connected to the radial elements 20*e*. In the embodiment, the plurality of circumferential elements 10*e* are spaced apart from each other along the radial direction, and further form different heights relative to the bottom surface B in a side direction perpendicular to the central axis J. In the embodiment, the circumferential element 14 disposed on the top T of the guiding grid 1*e* forms a top height H.

Figure 24:
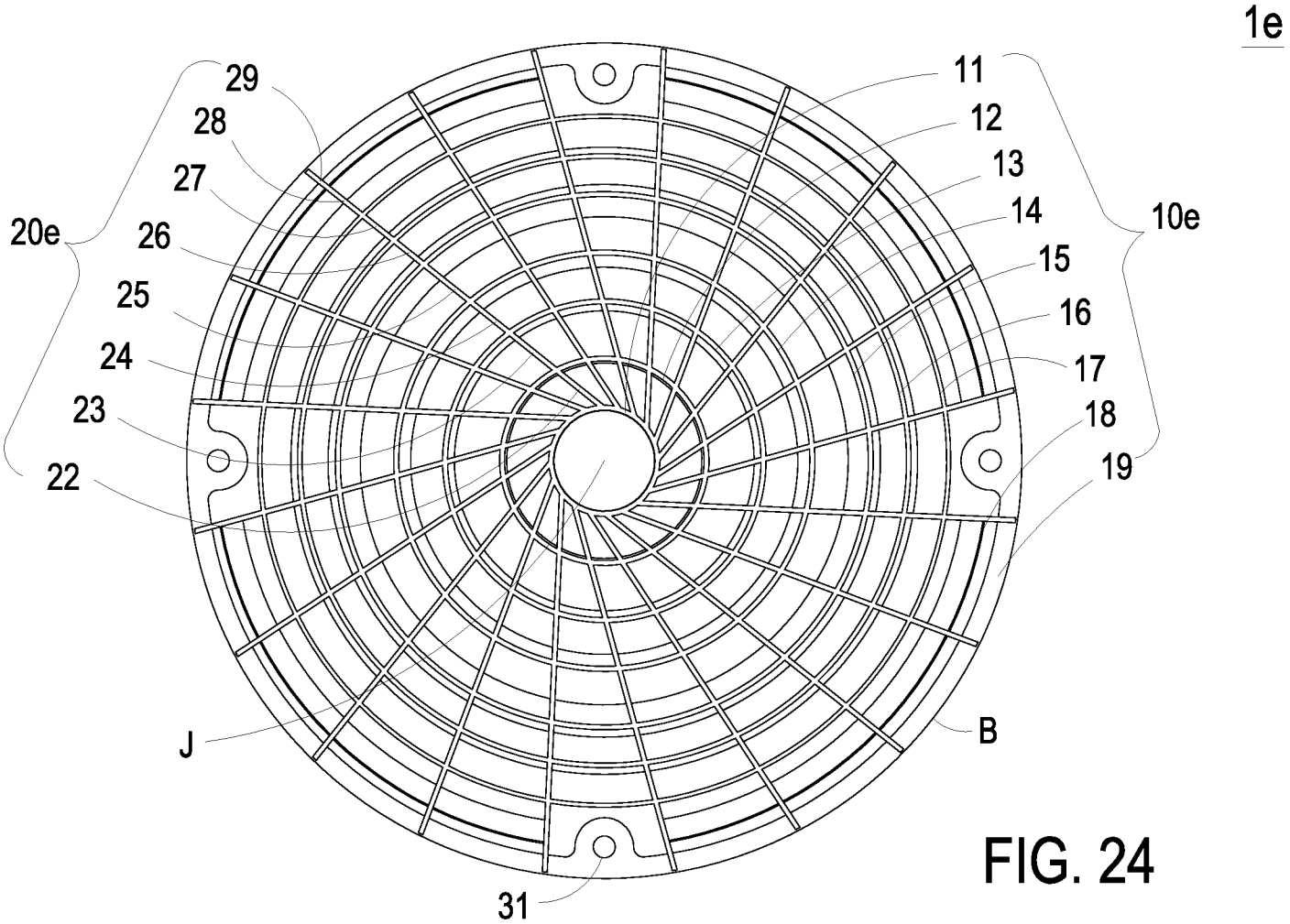
FIG. 24 is a top view illustrating the guiding grid according to the sixth embodiment of the present disclosure.

FIG. 24 is a top view illustrating the guiding grid according to the sixth embodiment of the present disclosure. In the embodiment, the guiding grid 1*d* includes four connection elements 31, which are spatially corresponding to the central axis J, disposed on the bottom surface B and equally spaced apart around the central axis J. In the embodiment, none of the four connection elements 31 intersects the radial elements 22, 23, 24, 25, 26, 27, 28, 29 in a continuous curve. The radial elements 22, 23, 24, 25, 26, 27, 28, 29 in the continuous curve are extended from the circumferential element 11 to the circumferential element 19 at the bottom surface B. When the guiding grid 1*e* is fastened to the inlet of the fan through the bottom surface B, it facilitates the guiding grid 1*e* to provide sufficient compressive strength and increase the reliability of the product. Certainly, the curved angle along the radial direction and the number of the radial element 20*e* are adjustable according to the practical requirements. The present disclosure is not limited thereto.

Figure 25:
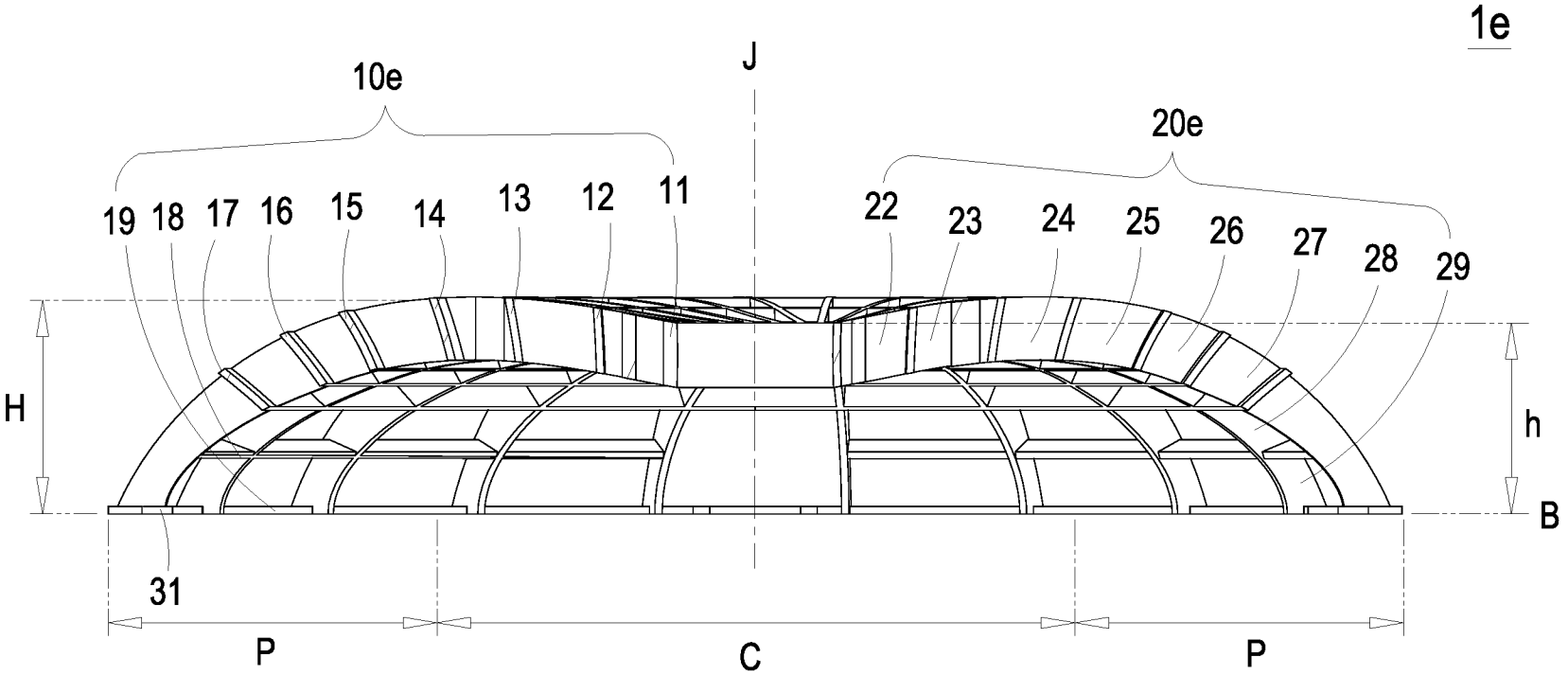
FIG. 25 is a cross-section view illustrating the guiding grid according to the sixth embodiment of the present disclosure.

FIG. 25 is a cross-section view illustrating the guiding grid according to the sixth embodiment of the present disclosure. In the embodiment. In the embodiment, the plurality of circumferential elements 11, 12, 13, 14, 15, 16, 17, 18, 19 are spaced apart from each other in the radial direction, and form different heights relative to the bottom surface B in the side direction perpendicular to the central axis J. One of the circumferential elements 10*e*, the circumferential element 14, forms a top height H. In that, the circumferential elements 10*e* are divided into an outer-ring region P and a central region C by the circumferential element 14. The plurality of circumferential elements 11, 12, 13 located in the central region C are increased in height relative to the bottom surface B from the central axis J along the radial direction. A central height h relative to the bottom surface B is formed adjacent to the central axis, and the central height h is less than the top height H. The plurality of circumferential element 15, 16, 17, 18, 19 located in the outer ring region P are reduced in height relative to the bottom surface B along the radial direction. In the embodiment, the plurality of radial elements 22, 22, 23, 24, 25, 26, 27, 28, 29 sequentially connected to the plurality of circumferential elements, 11, 12, 13, 14, 15, 16, 17, 18, 19 from inside to outside, and form a continuous curve or a plurality of connected lines. The present disclosure is not limited thereto. In the embodiment, the plurality of circumferential element 10*e* have inclination angles relative to the central axis J, respectively. Preferably but not exclusively, the inclination angle of the circumferential element 11 closest to the central axis J is about 0 degree relative to the central axis J. Preferably but not exclusively, the farthest one of the plurality of circumferential elements 10*e*, the circumferential element 19, is horizontal, has the inclination angle about 90° relative to the central axis J, and fits the bottom surface B. In other words, the inclination angles of the plurality of circumferential elements 10*e* are increased along the radial direction, and the inclination angles are ranged from 0° to 90°. Certainly, the present disclosure is not limited thereto.

Notably, in the above embodiments, the guiding grids 1, 1*a*, 1*b*, 1*c*, 1*d*, 1*e* are integrally formed by punching metal materials, or integrally formed by plastic injection molding. By using the locking holes of the connection elements 30, 31, it allows to fasten the guiding grids 1, 1*a*, 1*b*, 1*c*, 1*d*, 1*e* on the inlet of the fan, and the assembling process is simple. Furthermore, when the guiding grids 1, 1*a*, 1*b*, 1*c*, 1*d*, 1*e* are manufactured by punching metal materials or injection molding, it is easy to adjust the combination of the circumferential elements 10, 10*a*, 10*b*, 10*c*, 10*d*, 10*e* and the radial elements 20, 20*a*, so as to increase the diversion change for the inlet, ensure the compressive strength of the guiding grids 1, 1*a*, 1*b*, 1*c*, 1*d*, 1*e*, and achieve the purpose of reducing noise. Certainly, in other embodiments, the numbers, the forms, the sizes and the arrangements of the circumferential elements 10, 10*a*, 10*b*, 10*c*, 10*d*, 10*e* and the radial elements 20, 20*a*, 20*b*, 20*c*, 20*d*, 20*e* of the guide grids 1, 1*a*, 1*b*, 1*c*, 1*d*, 1*e* in the foregoing embodiments are adjustable according to the practical requirements. Under the requirement of structural support strength, when the guiding grids 1, 1*a*, 1*b*, 1*c*, 1*d*, 1*e* are designed asymmetrically, the blade-passage frequency (BPF) can be further dispersed to achieve the purpose of optimizing the sound quality. Certainly, the present disclosure is not limited thereto.

In summary, the present disclosure provides a guiding grid in connection with an inlet of a fan, so as to prevent the foreign matter from entering, protect the internal components of the fan, provide a uniform and stable flow field, and reduce the noise of the flow field. The guiding grid includes a plurality of radial elements extended from a bottom surface of an outer peripheral edge to a central axis and connected to a plurality of circumferential elements, so as to provide sufficient compressive strength and increase the reliability of the product. In addition, the plurality of radial elements are increased in number from the inside to the outside or are not parallel in the radial arrangement, so that the guiding grid is asymmetrically designed. It has advantages of providing the function of guiding, dispersing the blade-passage frequency (BPF), and reducing the generation of high-frequency noise. On the other hand, the guiding grid is integrally formed by stamping a metal material, or produced by plastic injection molding. Furthermore, the guiding grid is fixed to the fan by using the locking holes of the connection elements, and the assembly procedure is simple. In addition, when the guiding grid is manufactured by metal stamping or injection molding, it is easy to adjust the combination of the circumferential elements and the radial elements, so as to increase the variations of the guiding flow adjacent to the inlet of the fan, ensure the compressive strength of the guiding grid, and achieve the purpose of reducing noise.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A guiding grid in contact with an inlet of a fan, wherein the guiding grid comprises:

a plurality of circumferential elements disposed concentrically relative to a central axis, spaced apart from each other in a radial direction, and forming different heights relative to a bottom surface in a side direction perpendicular to the central axis, wherein one of the circumferential elements forms a top height relative to the bottom surface, so that the circumferential elements are divided into an outer-ring region and a central region in the radial direction, wherein the plurality of circumferential elements located in the central region are increased in height relative to the bottom surface along the radial direction, and the plurality of circumferential element located in the outer ring region are reduced in height relative to the bottom surface along the radial direction; and a plurality of radial elements connected between each of two adjacent circumferential elements, wherein at least one of the radial elements is misaligned and discontinuous in the radial direction, wherein each of the plurality of circumferential elements has an inclination angle relative to the central axis, and the inclination angles of the plurality of circumferential elements are increased along the radial direction outwardly, wherein the inclination angles are greater than or equal to 0° and less than 90°.

2. The guiding grid according to claim 1, wherein a number of the radial elements correspondingly connected to a father one of the circumferential elements away from the central axis is greater than a number of the radial elements correspondingly connected to a closer one of the circumferential elements adjacent to the central axis.

3. The guiding grid according to claim 1, wherein a closest one of the circumferential elements adjacent to the central axis is connected to the central axis through a part of the plurality of radial elements.

4. The guiding grid according to claim 1, wherein a farthest one of the circumferential elements away from the central axis is connected to the bottom surface through a part of the plurality of radial elements.

5. The guiding grid according to claim 1, further comprising a plurality of connection elements disposed on the bottom surface and equally spaced apart around the central axis.

6. The guiding grid according to claim 5, wherein the plurality of the connection elements are spatially corresponding to the central axis and connected to the central axis through the plurality of radial elements along the radial direction.

7. The guiding grid according to claim 1, wherein a part of the plurality of circumferential elements and a part of the plurality of radial elements located in the central region form a concave plane with a central height, and the central height is smaller than the top height.

8. A guiding grid in contact with an inlet of a fan, wherein the guiding grid comprises:

a plurality of circumferential elements disposed concentrically relative to a central axis, spaced apart from each other in a radial direction, and forming different heights relative to a bottom surface in a side direction perpendicular to the central axis, wherein the plurality of circumferential elements are reduced in height relative to the bottom surface along the radial direction, and a closest one of the circumferential elements adjacent to the central axis forms a top height relative to the bottom surface; and a plurality of radial elements connected between each of two adjacent circumferential elements, wherein at least one of the radial elements is misaligned and discontinuous in the radial direction, wherein each of the plurality of circumferential elements has an inclination angle relative to the central axis, and the inclination angles of the plurality of circumferential elements are increased along the radial direction outwardly, wherein the inclination angles are greater than or equal to 0° and less than 90°.

9. The guiding grid according to claim 8, wherein a number of the radial elements correspondingly connected to a father one of the circumferential elements away from the central axis is greater than a number of the radial elements correspondingly connected to a closer one of the circumferential elements adjacent to the central axis.

10. The guiding grid according to claim 8, comprising a plurality of connection elements disposed on the bottom surface and equally spaced apart around the central axis, wherein the plurality of the connection elements are spatially corresponding to the central axis and connected to the central axis through the plurality of radial elements along the radial direction.

11. A guiding grid in contact with an inlet of a fan, wherein the guiding grid comprises:

a plurality of circumferential elements disposed concentrically relative to a central axis, spaced apart from each other in a radial direction, and forming different heights relative to a bottom surface in a side direction perpendicular to the central axis, wherein one of the circumferential elements forms a top height relative to the bottom surface, so that the circumferential elements are divided into an outer-ring region and a central region in the radial direction, wherein the plurality of circumferential elements located in the central region are increased in height relative to the bottom surface along the radial direction, and the plurality of circumferential element located in the outer ring region are reduced in height relative to the bottom surface along the radial direction; and a plurality of radial elements connected between each of two adjacent circumferential elements, wherein the plurality of radial elements are disconnected with the central axis in the radial direction, and each of the plurality of circumferential elements has an inclination angle relative to the central axis, and the inclination angles of the plurality of circumferential elements are increased along the radial direction outwardly, wherein the inclination angles are ranged from 0° to 90°.

12. The guiding grid according to claim 11, wherein a closest one of the circumferential elements adjacent to the central axis forms a central height, and the central height is smaller than the top height.

13. The guiding grid according to claim 11, comprising a plurality of connection elements disposed on the bottom surface and equally spaced apart around the central axis, wherein the plurality of the connection elements are connected with each other through a farthest one of the circumferential elements.

* * * * *